US008016393B2

(12) United States Patent
Sekiguchi

(10) Patent No.: US 8,016,393 B2
(45) Date of Patent: Sep. 13, 2011

(54) LIQUID TRANSPORT APPARATUS AND METHOD FOR PRODUCING LIQUID TRANSPORT APPARATUS

(75) Inventor: Yasuhiro Sekiguchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 814 days.

(21) Appl. No.: 12/056,070

(22) Filed: Mar. 26, 2008

(65) Prior Publication Data

US 2008/0239018 A1 Oct. 2, 2008

(30) Foreign Application Priority Data

Mar. 30, 2007 (JP) ..... 2007-091165

(51) Int. Cl.
*B41J 2/045* (2006.01)

(52) U.S. Cl. ..... 347/70; 347/71

(58) Field of Classification Search ..... 347/68, 347/70, 71
See application file for complete search history.

(56) References Cited

U.S. PATENT DOCUMENTS

| | | | | |
|---|---|---|---|---|
| 5,710,584 | A * | 1/1998 | Suzuki et al. | 347/70 |
| 6,971,738 | B2 | 12/2005 | Sugahara | |
| 7,628,474 | B2 * | 12/2009 | Mita et al. | 347/70 |
| 2005/0259135 | A1 * | 11/2005 | Mita et al. | 347/70 |
| 2006/0038859 | A1 | 2/2006 | Sugahara | |
| 2006/0044359 | A1 * | 3/2006 | Sugahara | 347/68 |
| 2006/0152556 | A1 | 7/2006 | Sugahara | |
| 2007/0002092 | A1 * | 1/2007 | Kitakami et al. | 347/20 |
| 2008/0084458 | A1 * | 4/2008 | Sugahara | 347/70 |
| 2008/0186364 | A1 * | 8/2008 | Sugahara et al. | 347/70 |

FOREIGN PATENT DOCUMENTS

| | | | |
|---|---|---|---|
| JP | 2004079695 | A | 3/2004 |
| JP | 2006096034 | A | 4/2006 |
| JP | 2006123275 | A | 5/2006 |

* cited by examiner

*Primary Examiner* — Charlie Peng
(74) *Attorney, Agent, or Firm* — Baker Botts L.L.P.

(57) ABSTRACT

A method for producing a liquid transport apparatus comprises positioning and joining a vibration plate formed with recesses and a flow passage unit formed with pressure chambers, detecting a positional deviation amount of the recess from a reference position in a predetermined direction, and forming an electrode having a length adjusted on the basis of the detected positional deviation amount. Accordingly, it is possible to avoid the decrease in the pressure to be applied in the pressure chamber. Further, it is possible to appropriately discharge a liquid such as an ink or the like from a discharge port.

8 Claims, 14 Drawing Sheets

LIQUID TRANSPORT APPARATUS AND METHOD FOR PRODUCING LIQUID TRANSPORT APPARATUS

CROSS REFERENCE TO RELATED APPLICATION

The present application claims priority from Japanese Patent Application No. 2007-091165, filed on Mar. 30, 2007, the disclosure of which is incorporated herein by reference in its entirety.

BACKGROUND OF THE INVENTION

1. Field of the Invention

The present invention relates to a method for producing a liquid transport apparatus and the liquid transport apparatus.

2. Description of the Related Art

The liquid transport apparatus for transporting the liquid includes an ink-jet head for jetting an ink from nozzles to perform the printing.

For example, an ink-jet head, which is shown in FIGS. 16 and 17 of Japanese Patent Application Laid-open No. 2006-96034, comprises a flow passage unit which is provided with a plurality of pressure chambers communicated with nozzles, a vibration plate which covers the plurality of pressure chambers formed in the flow passage unit, a piezoelectric layer which is arranged on the upper surface of the vibration plate, and a plurality of individual electrodes which are arranged respectively in areas opposed to the plurality of pressure chambers on the upper surface of the piezoelectric layer.

A method for producing the ink-jet head includes firstly joining the vibration plate to the flow passage unit, subsequently forming the piezoelectric layer on the vibration plate, for example, by means of the CVD method or the AD method, and finally forming the individual electrodes at the predetermined positions corresponding to the respective pressure chambers on the piezoelectric layer.

When a predetermined driving voltage is applied between the individual electrode which is positioned on the upper surface of the piezoelectric layer and the vibration plate which serves as the common electrode positioned under or below the piezoelectric layer in the ink-jet head, then the piezoelectric layer is shrunk, and the bending deformation arises in the vibration plate. The volume of the pressure chamber is changed in response to the deformation of the vibration plate. Accordingly, the pressure is applied to the ink contained in the pressure chamber, and the ink is discharged from the nozzles.

On the other hand, Japanese Patent Application Laid-open No. 2006-96034 discloses an ink-jet head including individual electrodes which are formed in areas, on an upper surface of a piezoelectric layer, corresponding to circumferential edge portions of pressure chambers. This ink-jet head performs the so-called pull type jetting operation (pulling jet operation). The pull type jetting operation resides in the following driving method. That is, when the driving voltage is applied to the individual electrode, then the vibration plate is deformed so that the vibration plate is convex on the side opposite to the pressure chamber (to increase the volume of the pressure chamber), and the ink is introduced into the pressure chamber from the common liquid chamber. After that, the application of the driving voltage is stopped, and the deformation of the vibration plate is returned to provide the original form. Accordingly, the discharge pressure is applied to the ink contained in the pressure chamber.

A groove is formed in an area of the vibration plate opposed to a central portion of the pressure chamber in the ink-jet head. The area of the vibration plate formed with the groove has the rigidity which is lower than any other area formed with no groove, because the area formed with the groove is thin as compared with the area formed with no groove. As a result, the deformation of the vibration plate is caused with ease, and it is possible to lower the driving voltage.

The method for producing the ink-jet head described in Japanese Patent Application Laid-open No. 2006-96034 includes performing the positioning so that the groove is arranged while being overlapped with the central portion of the pressure chamber as viewed in the direction perpendicular to the vibration plate, joining the vibration plate and the flow passage unit to one another in this state, forming the piezoelectric layer over the entire region on the vibration plate after the joining, and forming the individual electrodes corresponding to the respective pressure chambers. In this procedure, the individual electrode is formed at the predetermined position on the basis of the groove positioned corresponding to the central portion of the pressure chamber.

However, when the vibration plate and the flow passage unit are pressed and joined to one another, the pressing force, which presses the vibration plate and the flow passage unit in the vertical direction, is also dispersed in the planar direction or the horizontal direction of the vibration plate and the flow passage unit in some cases. The vibration plate and the flow passage unit are sometimes joined to one another while being deviated by the dispersed force in the planar direction with respect to the arrangement in which the vibration plate and the flow passage unit are positioned.

As a result, the grooves are positioned while being deviated from the central portions of the pressure chambers. However, even in such a situation, the individual electrodes have been hitherto formed at the predetermined positions on the basis of the grooves as described above. Therefore, the individual electrodes are also formed at the deviated positions in some cases in the same manner as the grooves.

As a result, the area of the piezoelectric layer, which is deformed when the driving voltage is applied, is decreased. Any sufficient discharge pressure is not applied to the ink contained in the pressure chamber, and the ink is not discharged appropriately from the nozzles in some cases.

SUMMARY OF THE INVENTION

An object of the present invention is to provide a liquid transport apparatus in which the improvement in the reliability of the ink discharge is realized, and a method for producing the same.

According to a first aspect of the present invention, there is provided a method for producing a liquid transport apparatus which transports a liquid and which includes a flow passage unit having a pressure chamber in which an inflow port and a discharge port are formed, and a piezoelectric actuator including: a vibration plate which is joined to the flow passage unit to cover the pressure chamber, the vibration plate having a recess formed on a surface of the vibration plate in an area corresponding to a central portion of the pressure chamber, the surface not facing the pressure chamber; a piezoelectric layer arranged on the vibration plate; and a first electrode which applies an electric field to the piezoelectric layer and which is formed in an area of the piezoelectric layer or the vibration plate, the area not overlapping the central portion of the pressure chamber; and the method including:

joining the vibration plate and the flow passage unit to each other in a predetermined positional relationship;

detecting a positional deviation amount, between the vibration plate and the flow passage unit, in a predetermined direction based on the positional relationship after joining the vibration plate and the flow passage unit;

forming a piezoelectric layer by depositing a piezoelectric material on the vibration plate after detecting the positional deviation amount; and forming a first electrode on the piezoelectric layer or the vibration plate in an area overlapping with the pressure chamber such that a length of the first electrode in the predetermined direction is adjusted on the basis of the detected positional deviation amount in the predetermined direction.

In the liquid transport apparatus, the electric field is applied to the piezoelectric layer corresponding to the first electrode to deform the piezoelectric layer, and the vibration plate is deformed. Accordingly, the volume of the pressure chamber is changed to transport the liquid.

When the liquid transport apparatus is produced, the vibration plate and the flow passage unit are positioned to satisfy the predetermined positional relationship. That is, the vibration plate and the flow passage unit are positioned such that the recess is in the normal positional relationship corresponding to the central portion of the pressure chamber, and the vibration plate and the flow passage unit are joined to one another in the positioned state in the positioning and joining step. Subsequently, in the positional deviation-detecting step, the positional deviation in the predetermined direction of the recess is detected on the basis of the normal positional relationship (predetermined positional relationship). After that, in the piezoelectric layer-forming step, the piezoelectric layer is formed such that the piezoelectric layer is stacked on the vibration plate. In the first electrode-forming step, the first electrode, in which the length in the predetermined direction is adjusted on the basis of the positional deviation detected in the positional deviation-detecting step, is formed in the area overlapped with the pressure chamber. The positional deviation of the recess in the predetermined direction is detected on the basis of the normal positional relationship after joining the vibration plate and the flow passage unit. The first electrode, in which the length in the predetermined direction is adjusted on the basis of the detected positional deviation, is formed. Therefore, even when the vibration plate and the flow passage unit are joined to one another while being deviated from the position having been subjected to the positioning, it is possible to avoid the decrease in the area in which the pressure chamber and the first electrode are overlapped with each other. Accordingly, the area of the piezoelectric layer, in which the deformation is caused when the driving voltage is applied, is not decreased. It is possible to avoid the decrease in the pressure to be applied in the pressure chamber. Further, it is possible to appropriately discharge the liquid such as an ink or the like from the nozzle (discharge port). Therefore, it is possible to improve the reliability of the liquid discharge.

In the method for producing the liquid transport apparatus of the present invention, a pair of positioning indexes may be provided for the flow passage unit and the vibration plate respectively; and the recess may be positioned with respect to the pressure chamber by using the pair of positioning indexes when the vibration plate and the flow passage unit are positioned.

In this case, the vibration plate and the cavity plate can be positioned and joined to one another by using the positioning indexes in the positioning and joining step as described above. Therefore, the recess can be reliably positioned with respect to the pressure chamber.

In the method for producing the liquid transport apparatus of the present invention, when the positional deviation amount is detected, the positioning indexes may be used to detect the positional deviation amount of the recess in the predetermined direction. In this case, the positional deviation of the recess can be detected by using the positioning indexes. Therefore, it is unnecessary to provide any index for detecting the positional deviation for the vibration plate and the flow passage unit respectively. It is possible to simplify the arrangement of the vibration plate and the flow passage unit.

In the method for producing the liquid transport apparatus of the present invention, the first electrode may be formed after detecting the positional deviation amount, and then the piezoelectric layer may be formed; and after the piezoelectric layer is formed, a second electrode may be formed in an area of the piezoelectric layer on a side not facing the first electrode, the area overlapping with the first electrode.

In this case, the second electrode, which generates the electric field in the piezoelectric layer while being opposed to the first electrode, can be arranged on the piezoelectric layer. Therefore, the electric field can be reliably applied to the area in which the piezoelectric layer is driven.

In the method for producing the liquid transport apparatus of the present invention, the piezoelectric layer may be formed after detecting the positional deviation amount, and then the first electrode is formed; and after the positional deviation amount is detected and before the piezoelectric layer is formed, a second electrode may be formed in an area of the piezoelectric layer on a side not facing the first electrode, the area overlapping with the first electrode.

In this case, the second electrode, which generates the electric field in the piezoelectric layer while being opposed to the first electrode, can be arranged on the piezoelectric layer. Therefore, the electric field can be reliably applied to the area in which the piezoelectric layer is driven. Additionally, it is also possible to arrange the first electrode on the upper surface of the piezoelectric layer. Therefore, the wiring can be easily performed for the first electrode.

In the method for producing the liquid transport apparatus of the present invention, upon forming the first electrode, the first electrode may be formed to extend to an area of the piezoelectric layer overlapping with outer area of the flow passage unit located at the outside of the pressure chamber. In this case, the piezoelectric layer, which corresponds to the first electrode, can be allowed to extend to the area disposed outside the pressure chamber. Therefore, it is possible to increase the area in which the piezoelectric layer is deformed when the driving voltage is applied.

In the method for producing the liquid transport apparatus of the present invention, the piezoelectric layer may be formed by using an aerosol deposition method or a chemical vapor deposition method.

In this case, when the piezoelectric layer is formed by using the aerosol deposition method or the chemical vapor deposition method, the thickness of the piezoelectric layer deposited on the recess of the vibration plate can be thinned without applying any mask treatment. Therefore, it is possible to simplify the production steps.

In the method for producing the liquid transport apparatus of the present invention, the first electrode may be formed such that portions of the first electrode, which is overlapped with the partition wall portion has an identical area irrelevant to the positional deviation amount when the first electrode is formed. In this case, it is possible to suppress the amount of decrease in the discharge amount of the liquid and the amount of increase in the discharge speed or velocity of the liquid which would be otherwise caused by the crosstalk resulting from any adjoining pressure chamber.

According to a second aspect of the present invention, there is provided a liquid transport apparatus which transports a liquid; including a flow passage unit which includes a plurality of pressure chambers each having an inflow port and a discharge port for the liquid and partition walls partitioning the plurality of pressure chambers, the pressure chamber being elongated in a predetermined extending direction;

a plate member which is joined on the flow passage unit to cover the pressure chambers and which has recesses extending in the extending direction and being formed at areas of the plate member overlapped with the pressure chambers, respectively;

a piezoelectric layer which is deposited on the plate member; and first and second electrodes which are formed in areas of the piezoelectric layer on both sides in a perpendicular direction perpendicular to the extending direction of the recesses, the recesses overlapping with the pressure chambers, wherein each of the recesses is formed while being deviated from a central portion of one of the pressure chambers in the perpendicular direction;

the first and second electrodes have lengths which are different from each other in the perpendicular direction; and portions, of the first and second electrodes, which are overlapped with the partition walls of the flow passage unit have mutually same area.

According to the second aspect of the present invention, the lengths of the first and second electrodes in the perpendicular direction are different from each other, and the areal sizes of the first and second electrodes in the areas overlapped with the partition walls of the flow passage unit are identical with each other. Therefore, even when the vibration plate and the flow passage unit are joined to one another while being deviated from the positions having been subjected to the positioning or the positional adjustment, it is possible to avoid the decrease in the pressure to be applied in the pressure chamber. Further, it is possible to appropriately discharge the liquid from the discharge port or the outflow port. Therefore, it is possible to improve the reliability of the liquid discharge.

In the liquid transport apparatus of the present invention, a marker may be formed at a predetermined position of an area of the flow passage unit not overlapped with each of the pressure chambers, and a through-hole of which diameter is larger than the marker may be formed at a position of the plate member overlapped with the marker. In this arrangement, the marker, which is formed on the flow passage unit, can be optically (visually) confirmed through the through-hole of the plate member. Therefore, the amount of the positional deviation between the flow passage unit and the plate member can be optically detected.

DESCRIPTION OF THE PREFERRED EMBODIMENTS

An embodiment of the present invention will be explained. This embodiment is an example in which the present invention is applied to an ink-jet head for jetting an ink to the recording paper, provided as the liquid transport apparatus.

Figure 1:
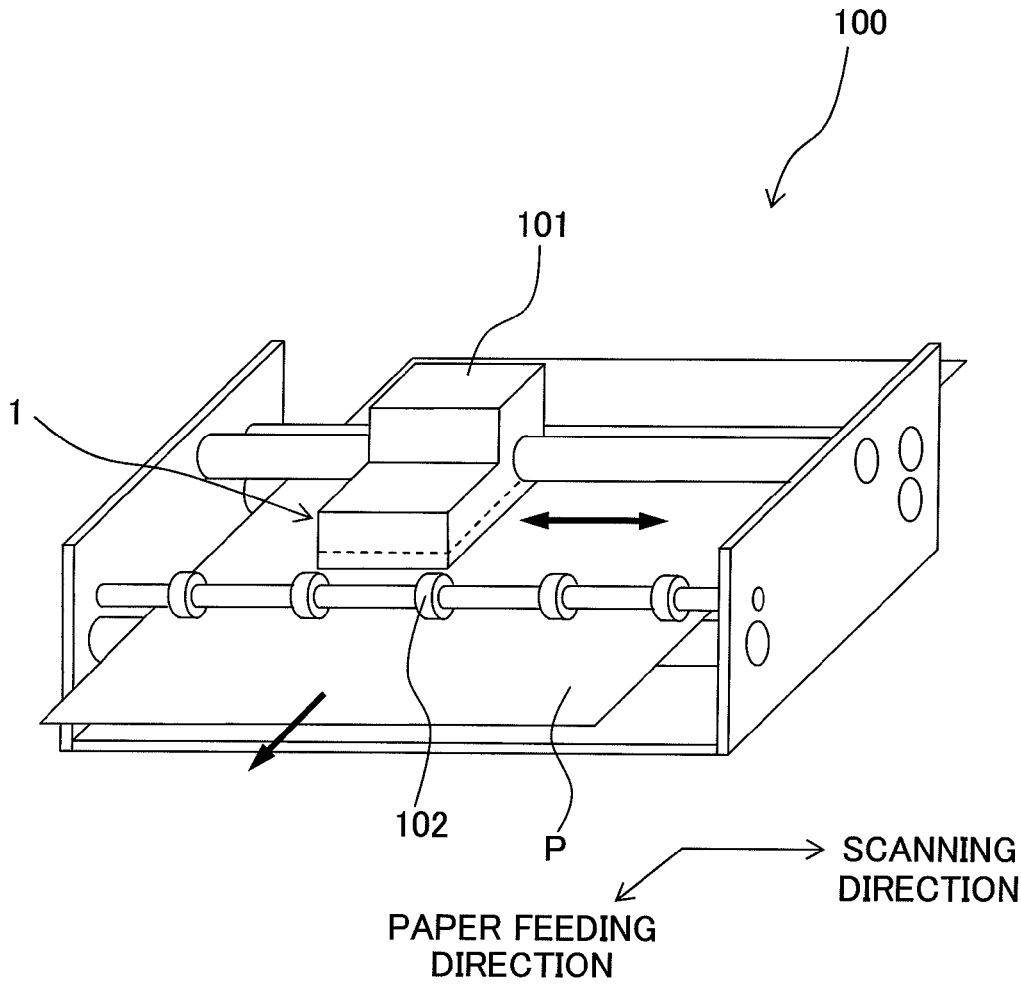
FIG. 1 schematically shows a perspective view illustrating an ink-jet printer according to an embodiment of the present invention.

At first, an ink-jet printer 100 provided with the ink-jet head 1 will be explained. As shown in FIG. 1, the ink-jet printer 100 includes, for example, a carriage 101 which is movable in the left-right direction as shown in FIG. 1, the serial type ink-jet head 1 which is provided on the carriage 101 to jet the ink to the recording paper P, and transport rollers 102 which transport the recording paper P in the frontward direction as shown in FIG. 1. Nozzles 20 are formed on the lower surface (ink discharge surface) of the ink-jet head 1 (see FIGS. 2 to 5). The ink-jet head 1 is moved in the left-right direction (scanning direction) integrally with the carriage 101 to jet the ink to the recording paper P from jetting ports of the nozzles 20 (see FIGS. 2 to 5) formed on the ink discharge surface. The recording paper P, on which any image or the like is recorded by the ink-jet head 1, is discharged in the frontward direction (paper feeding direction) by the transport rollers 102.

Next, the ink-jet head 1 will be explained in detail with reference to FIGS. 2 to 5.

Figure 2:
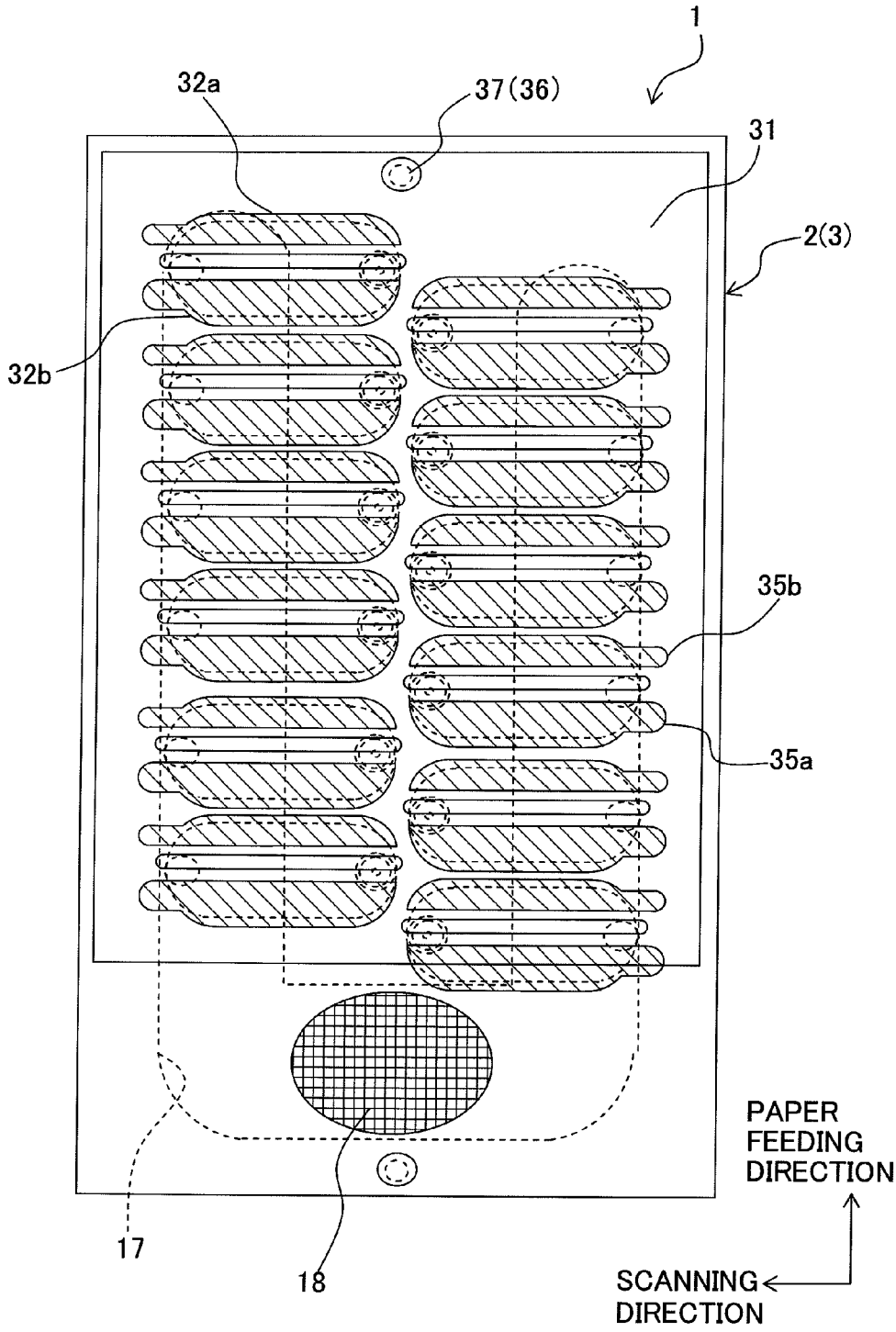
FIG. 2 shows a plan view illustrating the ink-jet head.
Figure 3:
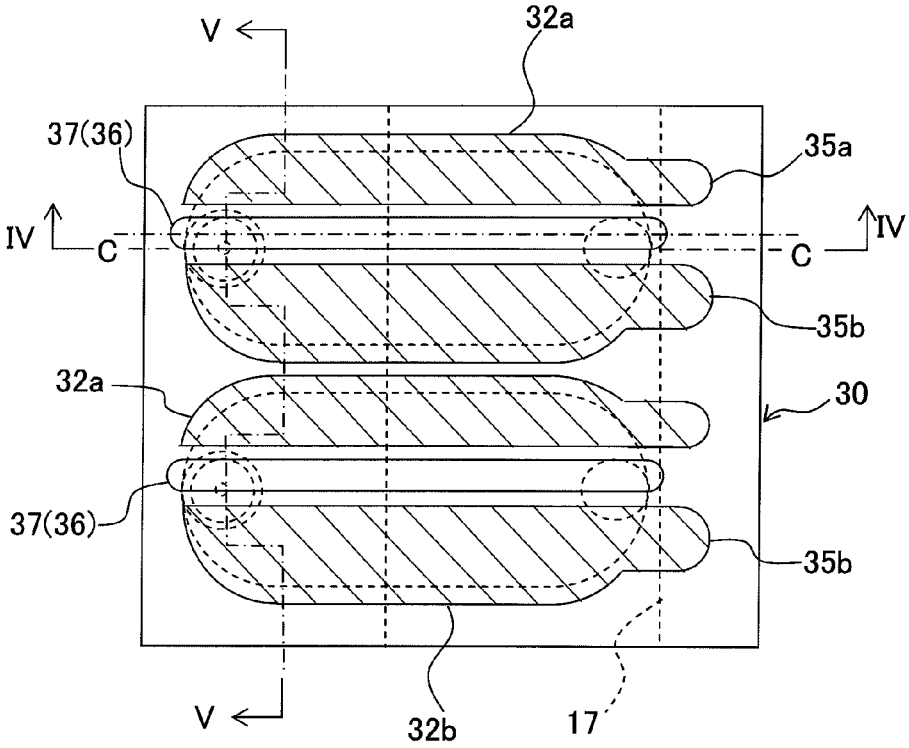
FIG. 3 shows a partial magnified plan view illustrating those shown in FIG. 2.
Figure 4:
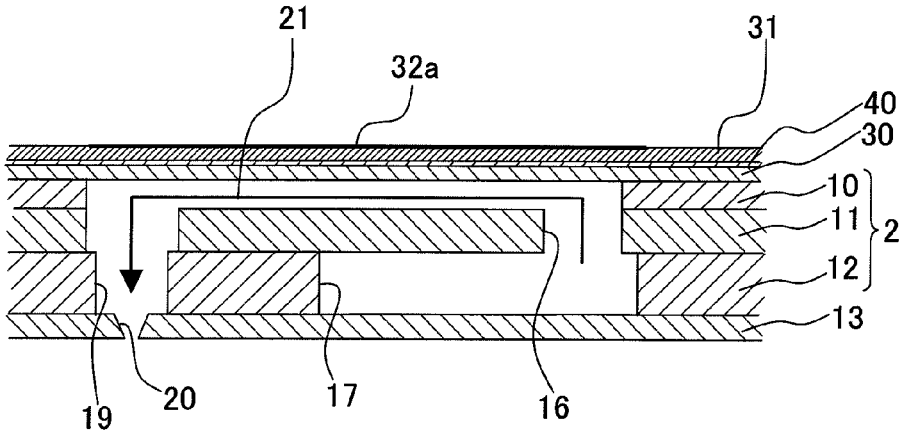
FIG. 4 shows a sectional view taken along a line IV-IV shown in FIG. 3.

As shown in FIGS. 2 to 4, the ink-jet head 1 is provided with a flow passage unit 2 and a piezoelectric actuator 3 which is stacked on the upper surface of the flow passage unit 2.

Further, as shown in FIG. 4, individual ink flow passages 21 including pressure chambers 14 are formed in the flow passage unit 2.

At first, the flow passage unit 2 will be explained. As shown in FIG. 4, the flow passage unit 2 includes a cavity plate 10, a base plate 11, a manifold plate 12, and a nozzle plate 13. The four plates 10 to 13 are adhered to one another in a stacked state. The cavity plate 10, the base plate 11, and the manifold plate 12 are the plates made of stainless steel. Therefore, ink flow passages, which include, for example, a manifold 17 and the pressure chambers 14 as described later on, can be easily formed for the three plates 10 to 12 by means of the etching. The nozzle plate 13 is formed of, for example, a high molecular weight synthetic resin material such as polyimide, which is adhered to the lower surface of the manifold plate 12. Alternatively, the nozzle plate 13 may be also formed of a metal material such as stainless steel in the same manner as the three plates 10 to 12.

As shown in FIGS. 2 to 4, a plurality of pressure chambers 14, which are arranged along the plane, are formed for the cavity plate 10. The plurality of pressure chambers 14 are open on the surface of the flow passage unit 2 (upper surface of the cavity plate 10 to which a vibration plate 30 is joined or bonded as described later on). The plurality of pressure chambers 14 are aligned in two arrays and each of the nozzle arrays are extending in the paper feeding direction (upward-downward direction as shown in FIG. 2). Each of the pressure chambers 14 is formed to have a substantially elliptical shape as viewed in a plan view. The pressure chambers 14 are arranged so that the major axis direction thereof (longitudinal direction thereof) is the left-right direction (scanning direction). Further, an ink supply port 18, which is connected to an unillustrated ink tank, is formed for the cavity plate 10. Further, a position marker 92 is installed on the cavity plate 10 in order to perform the positioning with respect to the vibration plate 30.

As shown in FIGS. 3 and 4, communication holes 15, 16 are formed at positions of the base plate 11 overlapped with the both ends of the pressure chamber 14 in the major axis direction as viewed in a plan view respectively. The manifold 17, which extends in the paper feeding direction (upward-downward direction as shown in FIG. 2) and which is overlapped with any one of the left and right ends of the pressure chamber 14 shown in FIG. 2 as viewed in a plan view, is formed for the manifold plate 12. The ink is supplied to the manifold 17 from the ink tank via the ink supply port 18. A communication hole 19 is also formed at a position overlapped with the end of the pressure chamber 14 disposed on the side opposite to the manifold 17 as viewed in a plan view. Further, a plurality of nozzles 20 are formed for the nozzle plate 13 at positions overlapped with the plurality of communication holes 19 respectively as viewed in a plan view. The nozzles 20 are formed, for example, by applying the excimer laser processing to a substrate of high molecular weight synthetic resin such as polyimide.

As shown in FIG. 4, the manifold 17 is communicated with the pressure chamber 14 via the communication hole 15, and the pressure chamber 14 is communicated with the nozzle 20 via the communication holes 16, 19. In this way, the individual ink flow passage 21, which ranges from the manifold 17 via the pressure chamber 14 to the nozzle 20, is formed in the flow passage unit 2.

Next, the piezoelectric actuator 3 will be explained. The piezoelectric actuator 3 of this embodiment discharges the ink such that the volume of the pressure chamber 14 is widened or increased, and then the volume is returned to generate the pressure in the pressure chamber 14. As shown in FIGS. 2 to 5, the piezoelectric actuator 3 includes the vibration plate 30 which is arranged on the upper surface of the flow passage unit 2, which is conductive, and which has recesses 36 formed on the upper surface, an insulating film 40 which is stacked on the surface of the vibration plate 30 formed with recesses 36, a piezoelectric layer 31 which is formed continuously to range over the plurality of pressure chambers 14 on the upper surface of the insulating film 40, a plurality of common electrodes 34*a*, 34*b* which are formed to correspond to the plurality of pressure chambers 14 between the piezoelectric layer 31 and the insulating film 40, and a plurality of individual electrodes 32*a*, 32*b* which are formed on the upper surface of the piezoelectric layer 31 while corresponding to the common electrodes 34*a*, 34*b* respectively.

The vibration plate 30 is a metal plate which has a substantially rectangular shape as viewed in a plan view. The vibration plate 30 is formed of, for example, iron-based alloy such as stainless steel, copper-based alloy, nickel-based alloy, or titanium-based alloy. The vibration plate 30 is stacked and joined onto the upper surface of the cavity plate 10 so that the openings of the plurality of pressure chambers 14 are closed therewith.

In this arrangement, as shown in FIG. 3, the recess 36 is arranged in the area of the upper surface (surface disposed on the side opposite to the flow passage unit 2) of the vibration plate 30, the area being overlapped with the pressure chamber 14. The center of the recess 36 is arranged at the position deviated from the center line C of the pressure chamber 14.

The recess 36 is formed to extend to an area disposed outside the area overlapped with the pressure chamber 14 as viewed in a plan view, on the upper surface of the vibration plate 30.

Figure 5:
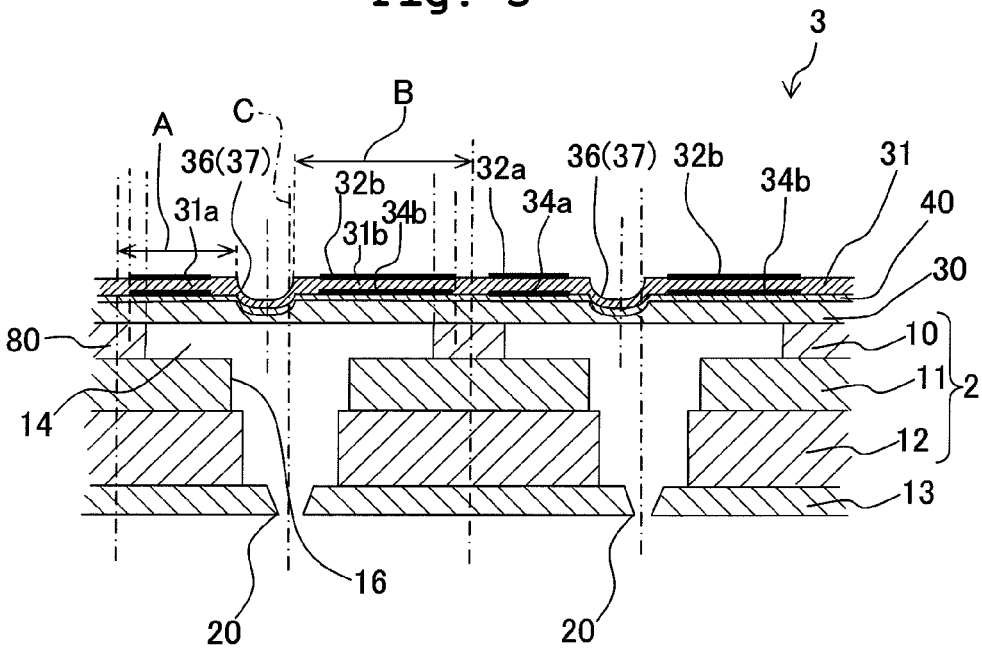
FIG. 5 shows a sectional view taken along a line V-V shown in FIG. 3.

FIG. 5 shows a sectional view illustrating the piezoelectric actuator 3. The center line C, which passes through the center in the lateral direction of the pressure chamber 14 (transverse direction orthogonal to the longitudinal direction of the pressure chamber 14), is arranged at the position corresponding to the center line C shown in FIG. 3 as viewed in a plan view of the vibration plate 30.

The common electrodes 34*a*, 34*b* are formed respectively at the left and the right of the area (formed so as to sandwich the area) overlapped with the recess 36 as viewed in a plan view, of the upper surface of the insulating film 40 formed on the upper surface of the vibration plate 30.

The widths of the common electrodes 34*a*, 34*b* are determined depending on the positional deviation amount A between the center of the recess 36 and the center line C of the pressure chamber 14.

In the piezoelectric actuator 3 of this embodiment, the width of the common electrode 34*a* is smaller than the width of the common electrode 34*b*.

The common electrodes 34*a*, 34*b* are arranged so that they are not disposed closely to the adjacent pressure chamber 14 by exceeding the center line K of the area (girder, beam) of the cavity plate for partitioning the two adjacent pressure chambers 14.

The common electrodes 34*a*, 34*b* may be overlapped with the edge portion of the pressure chamber 14 as viewed in a plan view.

The common electrodes 34*a*, 34*b* are electrically connected to one another (not shown), and they are retained at the same electric potential (for example, the ground electric potential). When the common electrodes 34*a*, 34*b* are connected to one another, for example, lead wires may be connected to the respective common electrodes 34*a*, 34*b* so that no interference is caused with the recess 36.

A through-hole 91 is bored through the area of the vibration plate 30 not overlapped with the pressure chamber 14 and the manifold 17 as viewed in a plan view. When the center of the through-hole 91 is overlapped with the center of the position marker 92 described above as viewed in the direction perpendicular to the planar direction of the vibration plate 30, the center of the recess 36 is arranged at the position overlapped with the center line C of the pressure chamber 14.

In this embodiment, the through-hole 91 is circular as viewed in a plan view. The through-hole 91 is formed to have the diameter which is slightly larger than the position marker 92. Therefore, the position marker 92 can be confirmed from the outside of the through-hole 91.

The piezoelectric layer 31, which contains a main component of lead titanate zirconate (PZT) as a ferroelectric material and as a solid solution of lead titanate and lead zirconate, is formed on the surfaces of the insulating film 40 and the common electrodes 34*a*, 34*b*. The piezoelectric layer 31 is formed continuously to range over the plurality of pressure chambers 14. However, recesses 37, which have the same or equivalent shapes as those of the recesses 36 as viewed in a plan view, are formed at the positions of the piezoelectric layer 31 corresponding to the recesses 36 formed on the vibration plate 30. As shown in FIGS. 4 and 5, the thickness of the piezoelectric layer 31 at the recess 37 is thinner than the thickness of the piezoelectric layer 31 in the other areas.

The individual electrodes 32*a*, 32*b* are formed at the positions overlapped with the common electrodes 34*a*, 34*b* as viewed in a plan view respectively, on the surface of the piezoelectric layer 31. When the driving voltage is applied to the individual electrodes 32*a*, 32*b*, the electric field is generated in the area of the piezoelectric layer interposed by the individual electrodes 32*a*, 32*b* and the common electrodes 34*a*, 34*b*. Accordingly, the piezoelectric layer 31, which is positioned between the electrodes, is deformed.

The individual electrodes 32*a*, 32*b* and the common electrodes 34*a*, 34*b* are arranged so that they are overlapped with each other as viewed in a plan view. Therefore, the electric field can be reliably applied to the area of the piezoelectric layer 31 interposed between the individual electrode 32*a* and the common electrode 34*a* and the area interposed between the individual electrode 32*b* and the common electrode 34*b*. It is possible to suppress the electric power consumption. A portion, of the piezoelectric layer 31, corresponding to one of the pressure chamber 14 has two areas (piezoelectric layer area 31*a* and piezoelectric layer area 31*b*) which are separated by the recess 37 (36). The piezoelectric layer area 31*a* and the piezoelectric layer area 31*b* are arranged in the left side and the right side of the recess 37 (36), respectively. In this case, each of widths A, B of the piezoelectric layers 31*a*, 31*b* means the length of the piezoelectric layers 31*a* (31*b*) from one end of the recess 36 to the position overlapped with the center of the girders 80.

The individual electrode 32*a*, 32*b* is formed of a conductive material such as gold. Further, terminals 35*a*, 35*b*, which are connected to the individual electrodes 32*a*, 32*b*, are formed respectively at positions not overlapped with the pressure chambers 14 as viewed in a plan view, on the surface of the piezoelectric layer 31. The terminals 35*a*, 35*b* are electrically connected to a driver IC (not shown) via a flexible wiring member such as a flexible printed circuit board. The driving voltage is selectively supplied from the driver IC via the terminals 35*a*, 35*b* to the respective individual electrodes 32*a*, 32*b*. The driving voltage is simultaneously supplied to the individual electrodes 32*a*, 32*b* which are overlapped with the same pressure chamber 14.

Next, the action of the piezoelectric actuator 3 of this embodiment will be explained with reference to FIG. 6.

Figure 6:
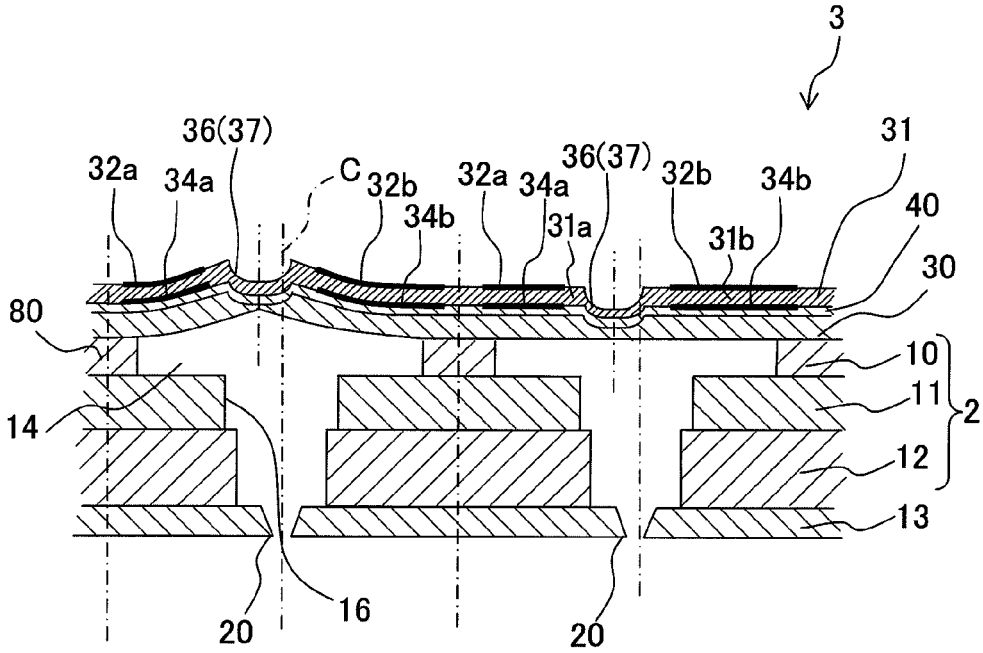
FIG. 6 shows the operation of a piezoelectric actuator 3 shown in FIG. 5.

In the piezoelectric actuator 3 of the present invention, when the driving voltage is applied to the individual electrodes 32*a*, 32*b*, as shown in FIG. 6, the vibration plate 30 is deformed so that the vibration plate 30 is convex toward the side opposite to the pressure chamber 14. In this situation, the ink is introduced into the pressure chamber from the manifold 17. After that, when the application of the driving voltage is stopped, the deformation of the vibration plate 30 is returned to the original state. In this situation, the pressure is applied to the ink contained in the pressure chamber 14, and the ink is discharged from the nozzle. When the driving voltage is cut off at the timing at which the negative pressure wave, which is generated in the ink contained in the pressure chamber when the vibration plate 30 is deformed so that the vibration plate 30 is convex toward the side opposite to the pressure chamber 14, is reversed to the positive pressure wave, the reversed positive pressure wave can be superimposed with the positive pressure wave which is generated in the ink when the deformation of the vibration plate is returned to the original state. Accordingly, the high pressure can be applied to the ink even when the driving voltage is low.

The area (driving area) of the piezoelectric layer 31, which is disposed between the individual electrode 32 and the common electrode 34, is shrunk in the direction perpendicular to the electrode stacking direction in accordance with the application of the driving voltage, and the area is elongated in the stacking direction. As shown in FIG. 6, the piezoelectric actuator 3 is arranged so that parts of the driving area are overlapped with the girders 80. When the driving voltage is applied to the piezoelectric layer 31, the deformation in the stacking direction of the area (constraint layer) of the piezoelectric layer 31 overlapped with the girder 80 is suppressed by the cavity plate 10. Accordingly, the piezoelectric layer 31 overlapped with the girder 80 is deformed in only the direction opposite to the cavity plate 10. On the contrary, the area (deformable layer) of the piezoelectric layer 31 not overlapped with the girder 80 is deformable toward the both sides in the stacking direction. As described above, the constraint layer can be deformed toward only one side in the stacking direction, and the deformation is restricted as compared with the deformable layer. In other words, the constraint layer is hardly deformed as compared with the deformable layer. Therefore, in the piezoelectric layer 31 in which the constraint layer and the deformable layer are connected to one another, the constraint layer behaves as the support point for the deformable layer at the portion at which the constraint layer and the deformable layer are connected to one another, and the deformable layer is shrunk and deformed toward the constraint layer. In this situation, nothing prohibits the deformation on the side opposite to the cavity plate 10 with respect to the piezoelectric layer 31. Therefore, the deformable layer is deformed toward the side opposite to the cavity plate 10. Therefore, the piezoelectric layer 31 deforms the vibration plate 30 so that the vibration plate 30 is convex on the side opposite to the pressure chamber 16.

Figure 7:
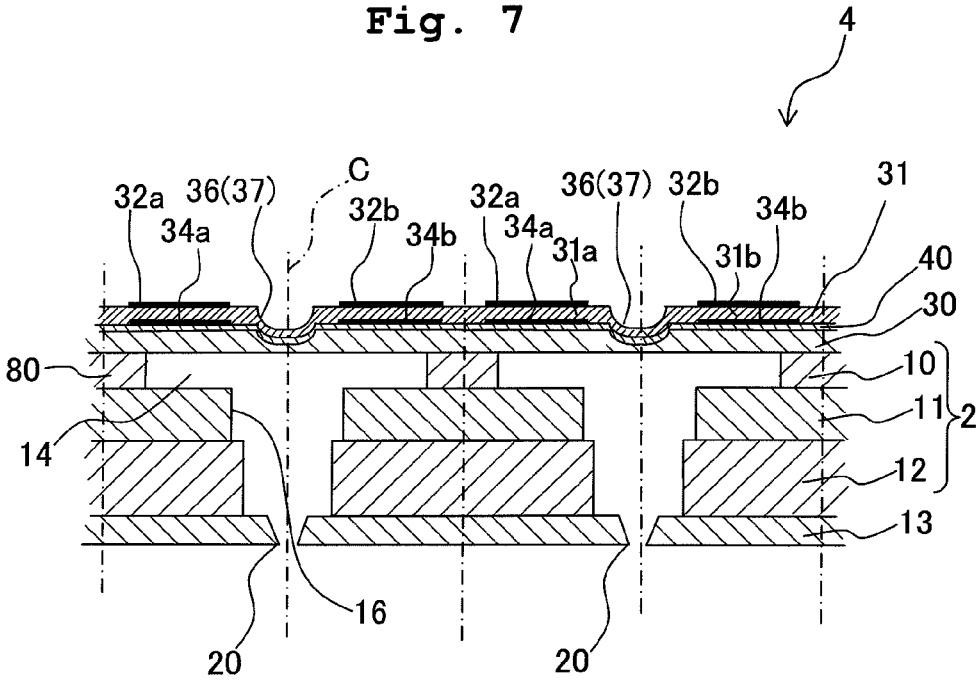
FIG. 7 shows a sectional view illustrating a piezoelectric actuator 4.
Figure 8:
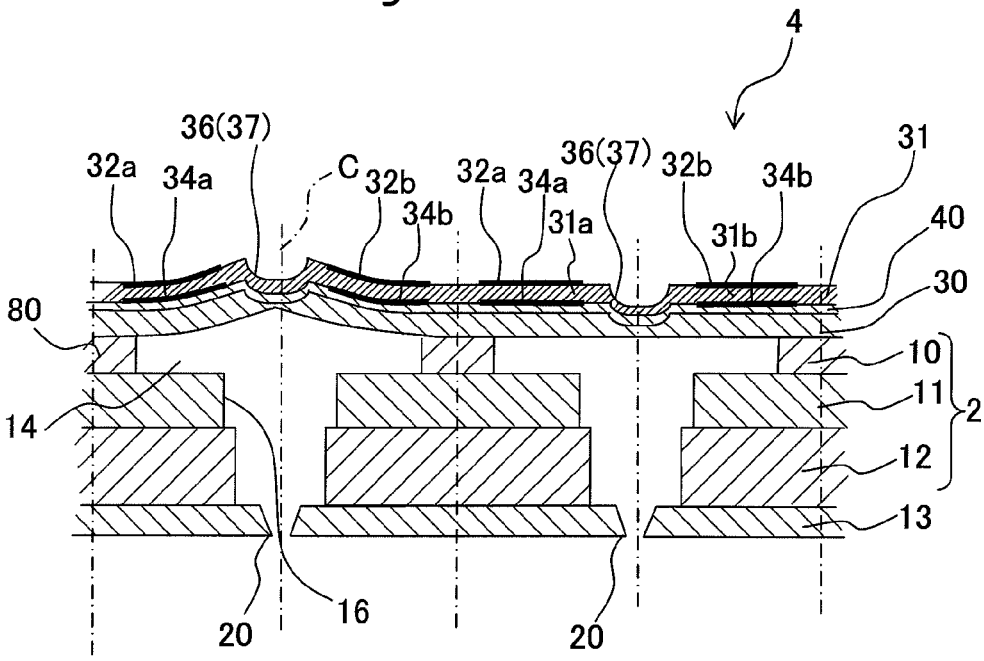
FIG. 8 shows the operation of the piezoelectric actuator 4.

As shown in FIGS. 7 and 8, a recess 36 is provided at a position overlapped with the center of the pressure chamber 14, of the vibration plate 30 in a conventional piezoelectric actuator 4, in order that the vibration plate 30 is easily deformed so that the vibration plate 30 is convex toward the side opposite to the pressure chamber 16. In the piezoelectric actuator 4, the common electrodes 34*a*, 34*b* are arranged evenly at the left side and the right side of the recess 36, respectively. Further, the common electrodes 34*a*, 34*b* have mutually same width. Corresponding to the common electrodes 34*a*, 34*b*, the individual electrodes 32*a*, 32*b* are also arranged evenly at the left side and the right side of the recess 36, respectively, and the individual electrodes 32*a*, 32*b* have mutually same width.

In the piezoelectric actuator 4, the driving voltage is applied to the individual electrodes 32*a*, 32*b*, and the vibration plate 30 is deformed to be convex in accordance with the shrinkage deformation of the piezoelectric layer 31, in the same manner as in the piezoelectric actuator 3 of the embodiment of the present invention. In the production of the piezoelectric actuator 4 as described above, when the vibration plate 30 and the cavity plate 10 are joined to one another, the recess 36 is sometimes arranged in a state in which the recess 36 is shifted (positionally deviated) with respect to an intended position, that is, a central position C of the pressure chamber 14. In such a situation, in the conventional technique, as in a piezoelectric actuator 5 shown in FIGS. 9 and 10, individual electrodes 32*a*, 32*b*, which have widths similar or equivalent to those of the piezoelectric actuator 4 shown in FIG. 8, have been arranged while being adjusted to the position of the recess 36.

Figure 10:
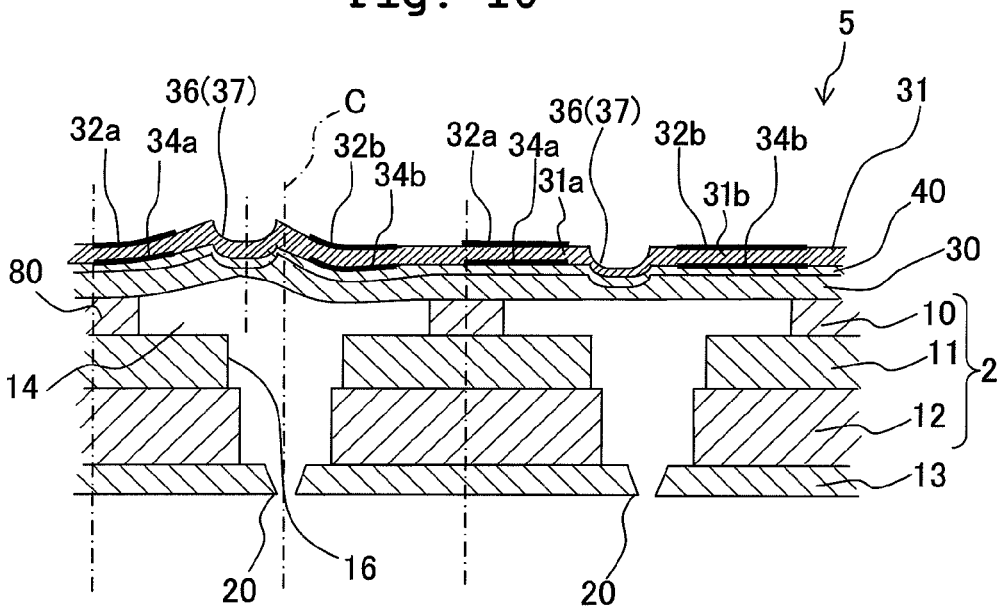
FIG. 10 shows the operation of the piezoelectric actuator 5.

In the case of the piezoelectric actuator 5, when the driving voltage is applied to the individual electrodes 32*a*, 32*b*, it is thought that the vibration plate 30 is deformed as shown in FIG. 10. It is also thought that the amount of deformation of the pressure chamber 14 is decreased. Further, the individual electrode 32*a* is formed in the vicinity of the adjoining pressure chamber 14. Specifically, the individual electrode 32*a* is formed to extend to an area of the piezoelectric layer, the area extending beyond an overlap-position overlapping with the center of the girder 80. Therefore, it is also assumed that any influence is exerted on the deformation of the vibration plate 30 corresponding to the adjoining pressure chamber 14.

When the ink discharge velocity is increased, the period of time, which is required for the ink discharged from the nozzle to land on the recording medium, is shortened. In the case of the ink-jet head provided with a plurality of nozzles, it is feared that the printing quality may be deteriorated when the ink discharge velocity is dispersed.

In view of the above, the present inventor prepared four models (Samples 1 to 4) corresponding to the piezoelectric actuators 3, 4, 5 to perform the simulation for the respective models in order to evaluate the discharge in relation to the ink-jet heads provided with the piezoelectric actuators 3, 4, 5 described above.

The amount of change of the volume of the pressure chamber 14 (volume deformation amount), which was to be obtained when the driving voltage was applied, was determined by using the finite element method as a general technique of the numerical analysis method in relation to the piezoelectric actuators 3, 4, 5.

In the models (Samples 1 to 4) of the piezoelectric actuators subjected to the analysis, the width of the pressure chamber 14 is 250 μm, the width of the recess 36 formed on the vibration plate 30 is 50 μm, the depth is 10 μm, the thickness of the vibration plate 30 is 20 μm, the thickness of the piezoelectric layer 31 is 10 μm, and the width of the girder 80 (a length between the center and the end of the girder) is 45 μm.

Figure 9:
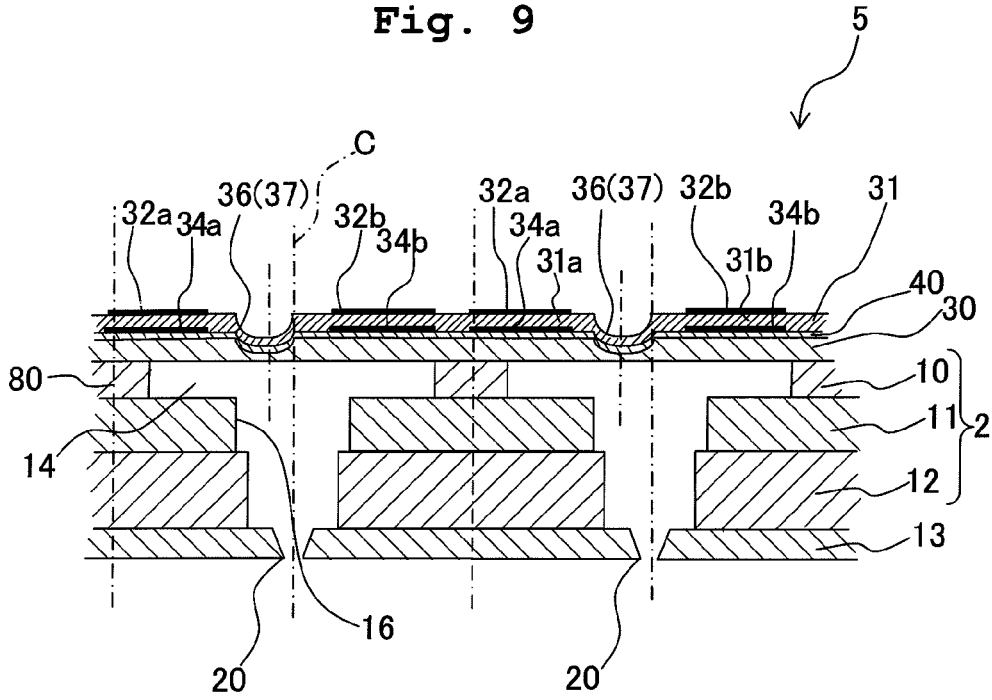
FIG. 9 shows a sectional view illustrating a piezoelectric actuator 5.

Sample 1 corresponds to the piezoelectric actuator 4 as shown in FIG. 7. In Sample 1, the widths of the individual electrodes 32*a*, 32*b* were set to 90 μm. Both of the individual electrodes 32*a*, 32*b* overlap with the girder 80, and the length of a portion, of each of the individual electrodes 32*a*, 32*b*, overlapping with the girder 80 is 17 μm. Sample 2 corresponds to the piezoelectric actuator 5 as shown in FIG. 9. In Sample 2, the center of the recess 36 is arranged at a position deviated leftwardly by 40 μm from the center line of the pressure chamber 14. Only the individual electrode 32*a* is overlapped with the girder 80, and the width thereof is 57 μm.

In the piezoelectric actuator 3 as the objective of this analysis, the widths of the individual electrodes 32*a*, 32*b* are adjusted with respect to the width A of the piezoelectric layer 31*a* and the width B of the piezoelectric layer 31*b* such that in the piezoelectric actuator 3 ratios of the widths of the individual electrodes 32*a*, 32*b* to the widths of the piezoelectric layers 31*a*, 31*b*, respectively are equivalent to those in the piezoelectric actuator 4. In the piezoelectric actuator 3 of this embodiment, the center of the recess 36 is arranged to be off to the left by 40 μm with respect to the center line of the pressure chamber 14. Therefore, the widths A, B of the piezoelectric layer 31*a*, 31*b* are 105 μm, 185 μm, respectively. The width of the individual electrode 32*a* is 65 μm, and the width of the individual electrode 32*b* positioned on the right side is 115 μm. In Sample 3 corresponding to the piezoelectric actuator 103A as will be described later (see FIG. 22), the individual electrodes 32*a*, 32*b* are arranged respectively at the central positions of the left and right piezoelectric layers 31*a*, 31*b*. In Sample 4, as shown in FIGS. 3 and 5, the arrangement is made such that the lengths of the individual electrodes 32*a*, 32*b* overlapped with the girder 80 are the same as those in Sample 1. In both of Sample 3 and Sample 4, the girder 80 is overlapped with the individual electrodes 32*a*, 32*b*. In Sample 3, the individual electrode 32*a* is 25 μm, and the individual electrode 32*b* is 10 μm. In Sample 4, both of the individual electrodes 32*a*, 32*b* are 17 μm.

Further, the volume change amount of the pressure chamber obtained when the driving voltage of 20 V was applied to the individual electrodes 32*a*, 32*b* corresponding to one pressure chamber 14 (hereinafter referred to as "1 ch driving" or "1 channel driving") and the volume change amount of the pressure chamber 14 obtained when the driving voltage was also simultaneously applied to the pressure chambers 14 disposed on the both sides of the concerning pressure chamber 14 (hereinafter referred to as "multi-ch driving" or "multi-channel driving") were determined for the respective samples by means of the numerical analysis method. Further, the driving volume increase ratio of the pressure chamber 14, which is obtained when the driving is simultaneously performed together with other channels or in the multi-channel, is also shown for each of the samples. The volume increase ratio can be considered as the increase ratio of the ink discharge velocity caused by the crosstalk. In the piezoelectric actuator as the objective of this analysis, the ink discharge velocity is increased by 0.7 m/s when the increase ratio of the ink discharge velocity is 4%. The increase amount m/s of the ink discharge velocity caused by the crosstalk was calculated and determined for each of the samples on the basis of the relationship described above.

The increase ratio of the ink discharge velocity was calculated for Samples 2 to 4 with respect to Sample 1 on the basis of the ink discharge velocity caused by the crosstalk obtained by the calculation. Further, the decrease ratio of the volume change amount was also calculated for the pressure chambers of Samples 2 to 4 with respect to Sample 1 upon the 1 ch driving. Table 1 shows the evaluation results in relation to the respective evaluation items on the basis of this analysis for the four samples described above.

TABLE 1

| | Deformation area ($\times 10^{-12}$) [$m^2$] | | Only 1 Ch driving, decrease ratio of deformation | Increase ratio of | Velocity change | Increase ratio of velocity change by crosstalk |
|---|---|---|---|---|---|---|
| | Only 1 Ch driving | All Ch simultaneous driving | area with respect to Sample 1 | deformation area by crosstalk | by crosstalk [m/s] | with respect to Sample 1 |
| Sample 1 | 8.87 | 9.20 | | 103.7% | 0.65 | |
| Sample 2 | 4.98 | 6.16 | −43.9% | 123.7% | 4.15 | 636.1% |
| Sample 3 | 6.32 | 6.86 | −28.7% | 108.5% | 1.49 | 228.2% |
| Sample 4 | 6.59 | 7.12 | −25.7% | 108.0% | 1.40 | 214.0% |

According to Table 1, the increase amount of the ink discharge velocity caused by the crosstalk was 0.65 m/s in Sample 1, while the increase amount was 4.15 m/s in Sample 2. As described above, it was confirmed that the velocity was increased approximately six times in Sample 2 as compared with Sample 1.

However, the increase amount of the ink discharge velocity caused by the crosstalk was 1.49 m/s in Sample 3, and the increase amount was 1.40 m/s in Sample 4. In any case, it was confirmed that the increase amount was extremely small as compared with the increase amount of the ink discharge velocity in Sample 2. Further, it was also confirmed that the increase amount was about twice as compared with the increase amount of the ink discharge velocity of Sample 1 as well.

Accordingly, the following fact has been confirmed. That is, even when the recess 36 is deviated from the center line of the pressure chamber 14, the increase amount of the discharge velocity caused by the crosstalk can be suppressed to a great extent in the case of those in which both of the individual electrodes 32*a*, 32*b* are overlapped with the girder 80 as in Samples 3 and 4, as compared with those in which the individual electrode 32*b* is not overlapped with the girder 80 as in Sample 2.

Further, the following fact has been confirmed. That is, the increase amount of the discharge velocity caused by the crosstalk can be further suppressed in Sample 4 in which the areas, in which the individual electrodes 32*a*, 32*b* are overlapped with the girder 80, are equal to those in Sample 1, as compared with Sample 3 in which the size of the area overlapped with the girder 80 differs between the individual electrodes 32*a*, 32*b*.

Therefore, in the piezoelectric actuators used in this analysis, even when the recess 36 is arranged while being deviated from the center of the pressure chamber 14, the increase amount of the discharge velocity caused by the crosstalk can be greatly suppressed as compared with the case in which the individual electrodes 32*a*, 32*b* are overlapped with the girder 80 in an unbalanced manner, by regulating or adjusting the lengths of the respective electrodes overlapped with the girder 80 by changing the widths of the individual electrodes 32*a*, 32*b* on the basis of the positional deviation of the recess 36 from the center of the pressure chamber 14 as in Samples 3 and 4.

Further, the increase amount of the discharge velocity can be further suppressed by making the arrangement such that the areas of the individual electrodes 32*a*, 32*b* overlapped with the girder 80 are allowed to have the equal areal size respectively.

In the results of this analysis, the difference in the velocity increase amount caused by the crosstalk with respect to Sample 1 can be greatly decreased in Samples 3 and 4 as compared with Sample 2. According to this fact, the following fact is appreciated. That is, the result, which is the same as or equivalent to that obtained in the embodiment of the present invention, is obtained such that when the recess 32 is positionally deviated from the pressure chamber, then the length of the electrode is adjusted and the electrode is arranged so that the area of the individual electrode overlapped with the girder 80 is equal to that obtained when the positional deviation is not caused, even in the case of any piezoelectric actuator in which various conditions including, for example, the size are changed in relation to the model of the piezoelectric actuator used in this numerical analyses.

The ink discharge amount with only 1 ch can be estimated from the deformation area or areal size of the pressure chamber. The deformation areal size of the pressure chamber 14 is $8.87\times10^{-12}$ $m^2$ in Sample 1, while the deformation areal size of the pressure chamber 14 is $4.98\times10^{-12}$ $m^2$ in Sample 2. According to this fact, the following fact is appreciated. That is, in the ink discharge with only 1 ch, the ink discharge amount in Sample 2 is decreased by as much as 43.9% as compared with Sample 1.

However, the deformation areal size in Samples 3 and 4 are $6.32\times10^{-12}$ $m^2$ and $6.59\times10^{-12}$ $m^2$ respectively. The decrease ratios with respect to Sample 1 are 28.7% and 25.7% respectively. In any case, the decrease in the ink discharge amount can be suppressed as compared with Sample 2.

In this numerical analysis, the total length of the portion of the individual electrode overlapped with the pressure chamber is 146 μm in Sample 1, 123 μm in Sample 2, 145 μm in Sample 3, and 146 μm in Sample 4.

In this arrangement, the total length of the portion of the individual electrode overlapped with the pressure chamber corresponds to the areal size of the area of the individual electrode overlapped with the pressure chamber. Therefore, in the case of the piezoelectric actuators used in this analysis, the following fact has been confirmed. That is, when the surface area size of the individual electrode 32*a*, 32*b* overlapped with the pressure chamber 14 is decreased, the ink discharge amount is decreased. Further, the following fact has been also confirmed. That is, when Samples 3 and 4 are compared with each other, the ink discharge amount is decreased even when the decrease amount of the area overlapped with the pressure chamber 14 is slight.

In the results of this analysis, the decrease in the ink discharge amount with respect to Sample 1 can be suppressed in Samples 3 and 4 as compared with Sample 2. In Samples 3 and 4, it has been confirmed that the decrease in the ink discharge amount is greatly suppressed as compared with Sample 2. Additionally, it has been confirmed that the ink discharge amount is decreased even when the area overlapped with the pressure chamber 14 is slightly decreased. According to this fact, the following fact is appreciated. That is, a tendency is obtained such that the ink discharge amount is decreased when the area overlapped with the pressure chamber 14 is decreased, without being limited to the models of the piezoelectric actuators used in this analysis.

Therefore, when the recess 36 is arranged at the position deviated from the center line of the pressure chamber 14, it is possible to secure the areal size of the individual electrode overlapped with the pressure chamber 14 by changing the size of the individual electrode on the basis of the positional deviation amount. Accordingly, even when the conventional recess 36 is arranged at the position deviated from the central position of the pressure chamber 14, then it is possible to suppress the decrease in the ink discharge amount, and it is possible to suppress the increase amount of the ink discharge velocity caused by the crosstalk, as compared with the case in which the arrangement is made about the center of the recess 36 without changing the size of the electrode.

In the method for producing the ink-jet head 1 in the embodiment of the present invention described below, the individual electrodes 32*a*, 32*b* are formed on the basis of those obtained in the results of this analysis.

Next, an explanation will be made with reference to FIGS. 11 to 19 about the method for producing the ink-jet head 1.

Figure 11:
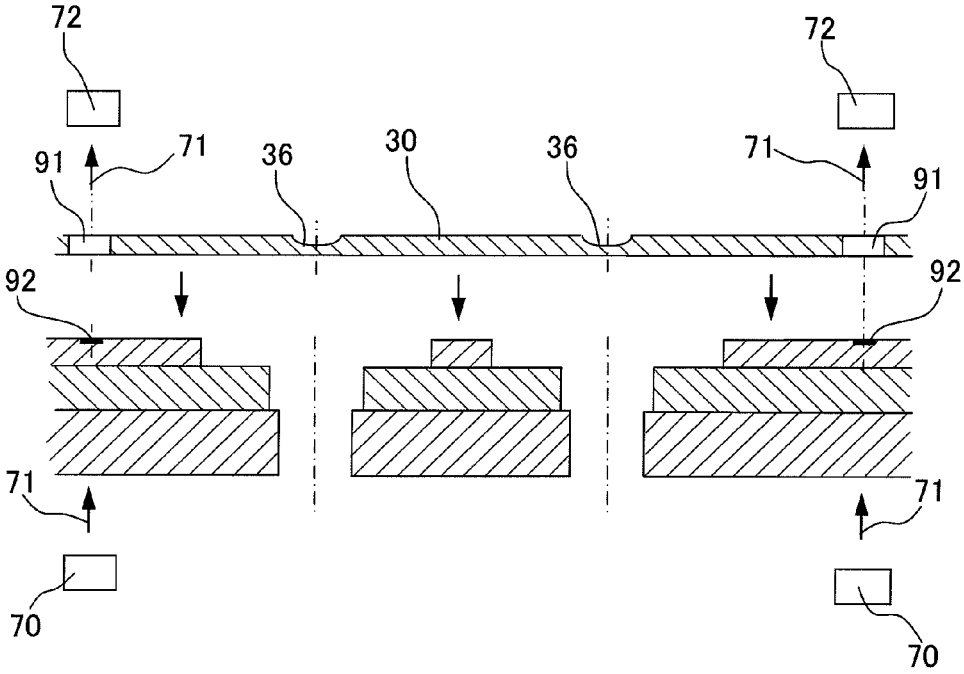
FIG. 11 shows a view as viewed in cross section illustrating the positioning and joining step.
Figure 12:
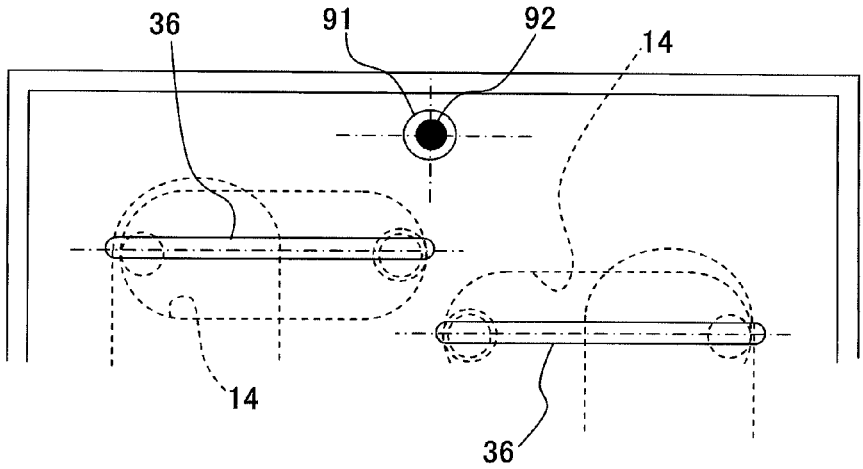
FIG. 12 shows a view as viewed from the upper surface in the step shown in FIG. 11.

At first, as shown in FIGS. 11 and 12, the three metal plates, i.e., the cavity plate 10, the base plate 11, and the manifold plate 12 other than the nozzle plate 13 made of the synthetic resin, which are included in the plates 10 to 13 for constructing the flow passage unit 2, are joined to one another. On the other hand, the recesses 36, which extend in the longitudinal direction of the pressure chambers 14 while passing through the centers of the respective pressure chambers 14 in the transverse direction perpendicular to the longitudinal direction, are formed on the upper surface of the vibration plate 30 (surface disposed on the side opposite to the surface to be joined to the flow passage unit 2) (recess-forming step). In this embodiment, the vibration plate 30 is composed of the metal material such as stainless steel. Therefore, the recesses 36 can be easily formed, for example, by means of the etching or the press working.

As shown in FIG. 12, when the vibration plate 30 is joined to the upper surface of the cavity plate 10, the positioning is performed by using the through-hole 91 provided for the vibration plate 30 and the position marker 92 provided for the cavity plate 10 such that the recesses 36 formed on the vibration plate 30 are overlapped with the center lines C of the pressure chambers 14 as viewed in a plan view of the vibration plate 30.

At first, the vibration plate 30 is stacked on the surface of the flow passage unit 2 disposed on the side of the cavity plate 10, and the vibration plate 30 is arranged between a light source 70 and an image-receiving device 72 such as a microscope. The light beam 71 emitted from the light source 70 is radiated in the stacking direction of the vibration plate 30 and the flow passage unit 2, and the light beam 71 is allowed to come into the image-receiving device 72. As described above, the inner diameter of the through-hole 91 is slightly larger than the outer diameter of the position marker 92. Therefore, as shown in FIG. 12, the image-receiving device 72 can recognize the position marker 92 at the inner diameter portion of the through-hole 91. Therefore, the through-hole 91 and the position marker 92 can be respectively positioned with ease. The positioning is performed in relation to the position markers 92 disposed at the two positions so that the deviations with respect to the corresponding through-holes 91 are equivalent to one another. In this state, the vibration plate 30 is joined to the upper surface of the cavity plate 10 to cover the plurality of pressure chambers 14 therewith by means of the diffusion bonding (diffusion joining) or the adhesive (positioning and joining step). Subsequently, the positional deviation-detecting step is performed to detect whether or not the center of the recess 36 is arranged while being deviated from the center line of the pressure chamber 14.

Figure 13:
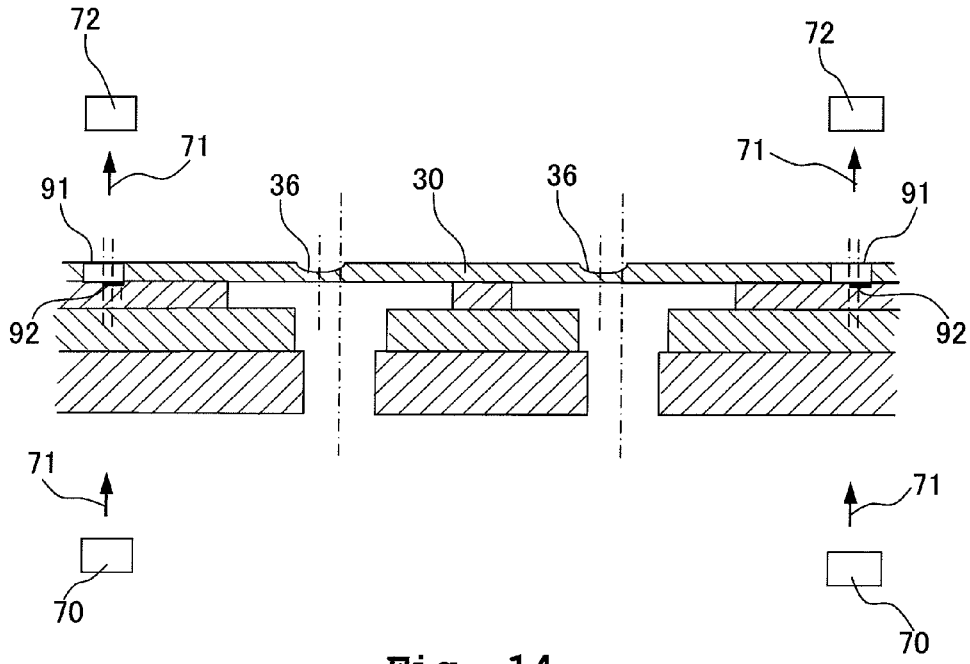
FIG. 13 shows a view as viewed in cross section illustrating the positional deviation-detecting step.
Figure 14:
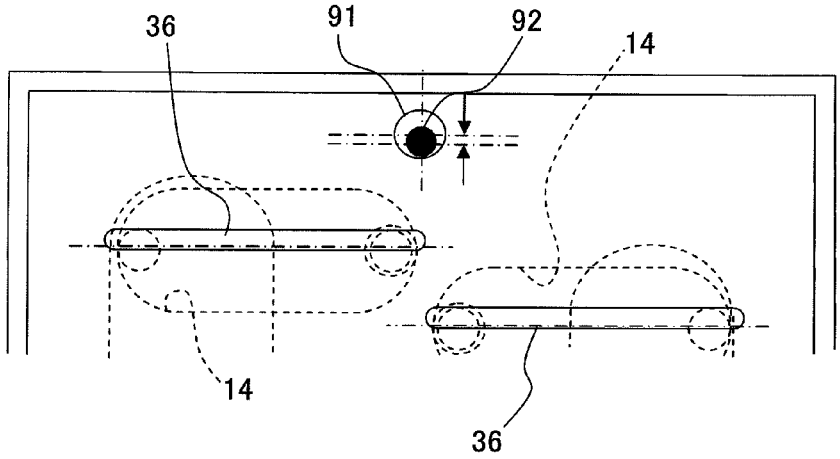
FIG. 14 shows a view as viewed from the upper surface in the step shown in FIG. 13.

Specifically, as shown in FIGS. 13 and 14, the light beam 71 is emitted from the light source 70 in the same manner as in the positioning performed during the joining of the vibration plate 30 and the flow passage unit 20 described above, after the vibration plate 30 and the flow passage unit 2 are joined to one another. The emitted light beam 71 is allowed to come into the image-receiving device 72. The image analysis is performed by means of an image-processing device (not shown) connected to the image-receiving device 72. Accordingly, the positional deviation amount is measured between the center of the through-hole 91 and the center of the position marker 92 in the through-hole 91.

The sizes of the individual electrode and the common electrode to be formed in the common electrode-forming step and the individual electrode-forming step described later on are adjusted, on the basis of the analysis result obtained in Table 1, with respect to the positional deviation amount measured in this procedure.

Figure 15:
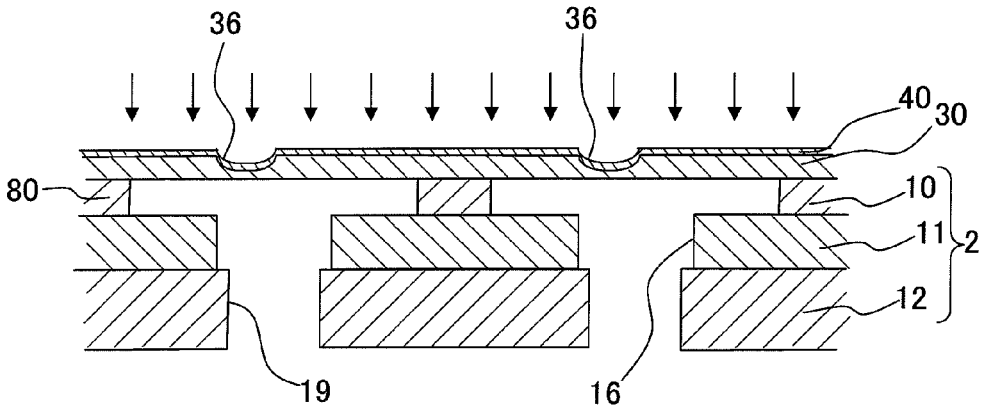
FIG. 15 shows a view as viewed in cross section illustrating the insulating film-forming step.

Subsequently, as shown in FIG. 15, the insulating film 40 is formed on the surface of the vibration plate 30 disposed on the side opposite to the flow passage unit 2 (insulating film-forming step). In the insulating film-forming step, for example, the ceramics material such as alumina or zirconia is deposited on the surface of the vibration plate 30, for example, by means of the chemical vapor deposition (CVD) method, the aerosol deposition method (AD method), or the sputtering method to form the insulating film 40 thereby. In this procedure, parts of the insulating film 40 stacked on areas of the surface of the vibration plate 30 formed with the recesses 36 are recessed. Accordingly, the recesses, which have the same shapes as those of the recesses 36 of the vibration plate 30 as viewed in a plan view, are formed on the insulating film 40.

Figure 16:
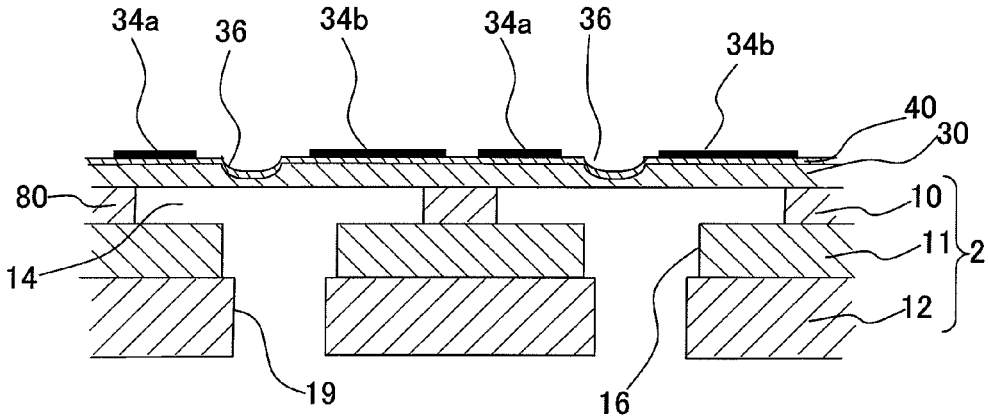
FIG. 16 shows a view as viewed in cross section illustrating the common electrode-forming step.
Figure 17:
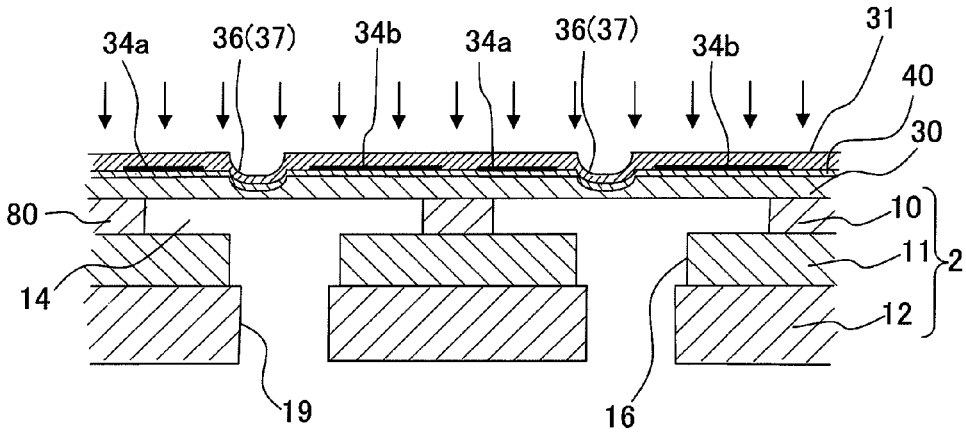
FIG. 17 shows a view as viewed in cross section illustrating the piezoelectric layer-forming step.

Subsequently, as shown in FIG. 16, the common electrodes 34*a*, 34*b*, which have sizes adjusted on the basis of the positional deviation amount obtained in the positional deviation-detecting step as described above, are formed by using, for example, the screen printing method, the vapor deposition method, or the sputtering method (common electrode-forming step). In this procedure, the areal sizes of the areas of the common electrodes 34*a*, 34*b* overlapped with the girder 80 of the pressure chamber 14 are adjusted so that the areal sizes are the same as the areal sizes to be provided when the positional deviation is absent. Subsequently, as shown in FIG. 17, the piezoelectric layer 31 is formed on the upper surfaces of the common electrodes 34 and the insulating film 40 (piezoelectric layer-forming step). In this procedure, in the piezoelectric layer-forming step, particles of the piezoelectric material are deposited on the surfaces of the insulating film 40 and the common electrodes 34, for example, by means of the CVD method or the AD method to form the piezoelectric layer 31 thereby. In this procedure, the piezoelectric layer 31 is deposited in the recessed form in the areas of the vibration plate 30 in which the recesses 36 are formed, in the same manner as the insulating film 40 formed in the insulating film-forming step described above. Therefore, the recesses 37, which have the same shapes as those of the recesses 36 of the vibration plate 30 as viewed in a plan view, are also formed on the piezoelectric layer 31.

Figure 18:
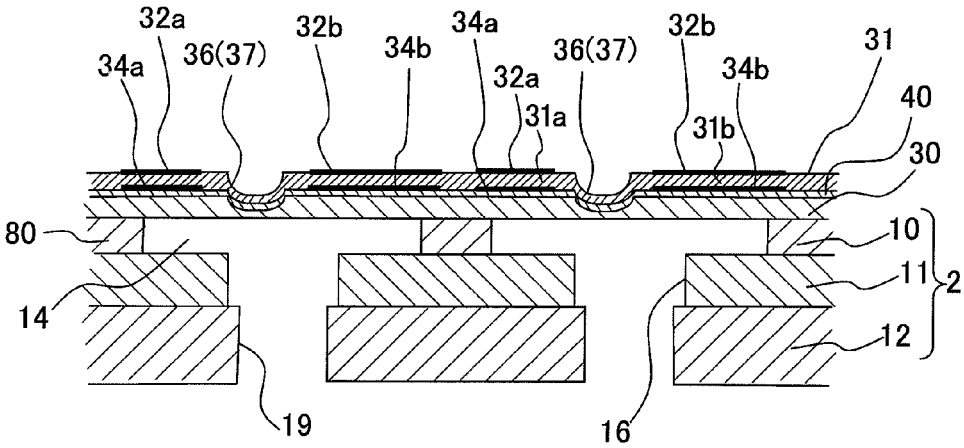
FIG. 18 shows a view as viewed in cross section illustrating the individual electrode-forming step.
Figure 19:
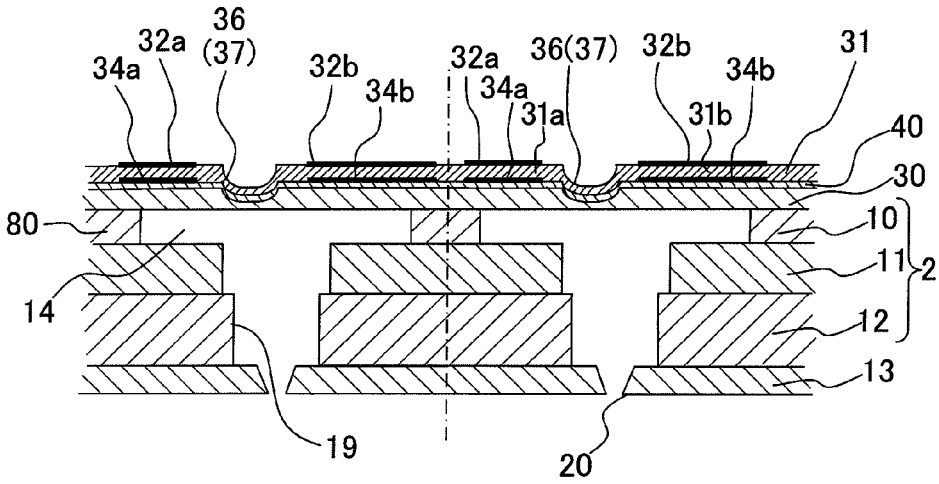
FIG. 19 shows a view as viewed in cross section illustrating the step of joining a nozzle plate 13 to a lower surface of a manifold plate 12.

After the piezoelectric layer 31 is formed on the surface of the vibration plate 30, the annealing treatment is performed in order that the sufficient piezoelectric characteristic is secured for the piezoelectric layer 31. Subsequently, as shown in FIG. 18, the plurality of individual electrodes 32*a*, 32*b* are formed in the areas of the surface of the piezoelectric layer 31 overlapped with the plurality of common electrodes 34 respectively as viewed in a plan view of the piezoelectric layer 31 by using, for example, the screen printing method, the vapor deposition method, or the sputtering method (individual electrode-forming step). Finally, as shown in FIG. 19, the nozzle plate 13 made of the synthetic resin is joined to the lower surface of the manifold plate 12 to complete the production of the ink-jet head 1.

Figure 20:
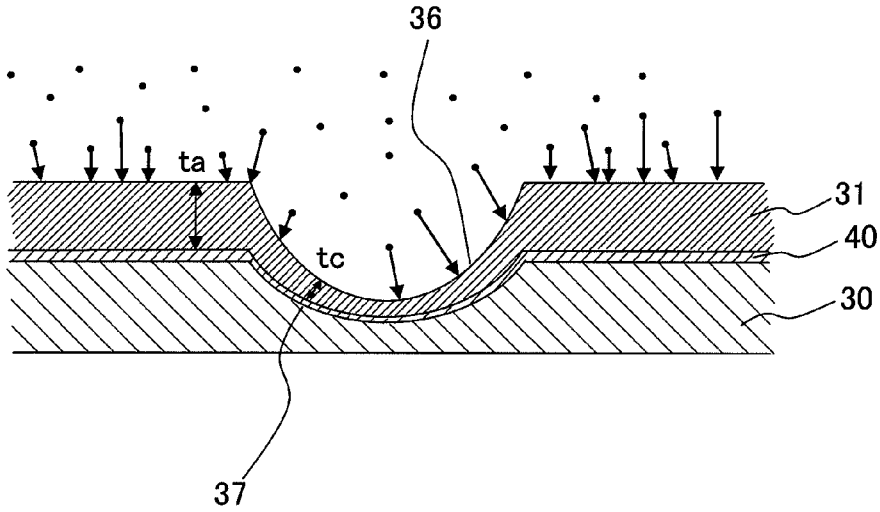
FIG. 20 illustrates the piezoelectric layer-forming step based on the CVD method.

An explanation will now be made about a procedure in which the piezoelectric layer 31 is formed by using the CVD method. In the piezoelectric film-forming step in this embodiment, for example, the metalorganic chemical vapor deposition (MOCVD) method is used to form the piezoelectric film by dissolving a raw material in an organic solvent to effect the vaporization so that the vapor phase reaction is caused on a treatment surface to form the thin film. Those usable as the raw material include, for example, lead bis(dipivaloylmethanate) ($Pb(DPM)_2$), zirconium tetrakis(dipivaloylmethanate) ($Zr(DPM)_4$), and titanium (diisopropoxy-dipivaloylmethanate) ($Ti(iPrO)_2\ (DPM)_2$) (see, for example, Japanese Patent Application Laid-open No. 2004-79695). When the vibration plate 30 is heated to about 600° C., then the vapor phase reaction is caused between the raw materials as described above on the surface of the vibration plate 30, and the piezoelectric layer 31 is formed on the surface of the vibration plate 30. In this procedure, as shown in FIG. 20, the raw material gas is hardly supplied to the inner side of the recess 36 formed on the vibration plate 30 as compared with the surface of the vibration plate 30 formed with no recess 36. Therefore, the velocity of formation of the piezoelectric layer 31 is slow on the surface of the recess 36. Therefore, the thickness "tc" of the piezoelectric layer 31 at the recess 37 is thinner than the thickness "ta" of the piezoelectric layer 31 in the other areas.

Figure 21:
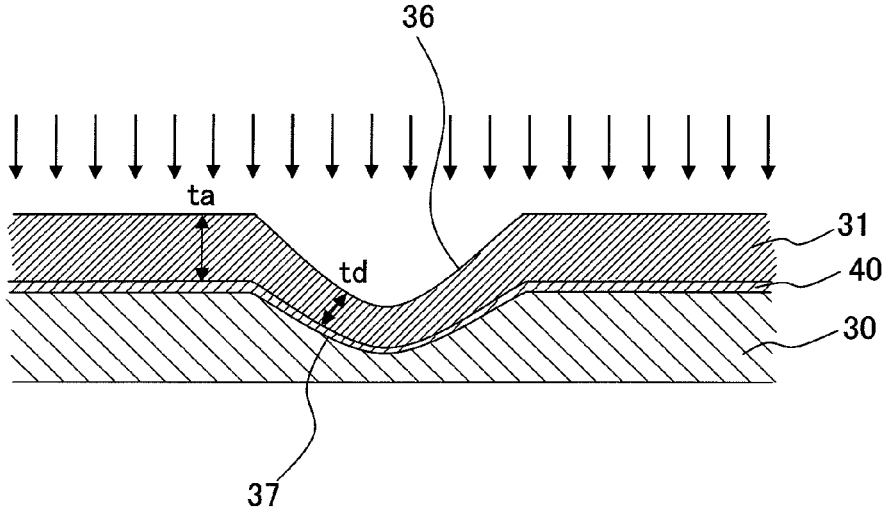
FIG. 21 illustrates the piezoelectric layer-forming step based on the AD method.

On the other hand, when any recess such as the recess 36 is formed, and when the piezoelectric layer 31 is formed by using the AD method in which an ultrafine particle material is allowed to collide with the treatment objective surface at a high velocity together with the carrier gas as shown in FIG. 21, the upward blow of the fine particles is caused in the recess 36. When the fine particles are jetted, the fine particles are blown from inside toward outside in the recess 36. Accordingly, the jetting velocity of the jetted fine particles is decreased or weakened, and the fine particles, which do not contribute to the film formation, are rebounded at a large ratio on the inner surface of the recess 36. Therefore, the fine particles are hardly deposited on the inner surface of the recess 36. As described above, the particles of the piezoelectric material are hardly deposited on the inner surface of the recess 36 as compared with the surface of the vibration plate 30. Therefore, as shown in FIG. 21, the thickness "td" of the recess 37 of the piezoelectric layer 31 formed in the recess 36 is thinner than the thickness "ta" of the piezoelectric layer 31 in the other areas.

The explanation has been made about the case in which the piezoelectric layer 31 is formed on the vibration plate 30 after the positional deviation-detecting step in the steps of producing the ink-jet head 1 described above. However, the common electrode-forming step may be provided, in which the common electrodes 34 are formed on the surface of the vibration plate 30 after the positional deviation-detecting step. In this case, the individual electrodes are formed in place of the common electrodes on the surface of the piezoelectric layer 31 to make contact with the vibration plate.

Alternatively, the vibration plate 30, on which the recesses 36 are formed, may be joined to the cavity plate 10, and then the other metal plates (base plate 11 and manifold plate 12) may be joined to the surface of the cavity plate 10 disposed on the side opposite to the vibration plate 30 to construct the flow passage unit 2. In this procedure, the positional deviation-detecting step described above may be performed after joining the vibration plate 30 and the cavity plate 10. Further alternatively, the positional deviation-detecting step may be performed after joining the other metal plates to the cavity plate 10.

When the nozzle plate 13 is a metal plate composed of, for example, stainless steel, the nozzle plate 13 may be joined to the other three metal plates (cavity plate 10, base plate 11, and manifold plate 12) to previously form the flow passage unit 2 before the vibration plate 30 is joined to the cavity plate 10. After that, the vibration plate 30 and the cavity plate 10 may be jointed to one another to perform the positional deviation-detecting step.

Further, in the embodiment of the present invention, in the positioning and joining step, when the vibration plate 30 and the cavity plate 10 are joined to one another, the positioning is performed by using the through-holes 91 formed for the vibration plate 30 and the position markers 92 formed for the cavity plate 10. However, the positioning may be performed by providing any jig for performing the positioning at the outer edges of the vibration plate 30 and the cavity plate 10.

Figure 22:
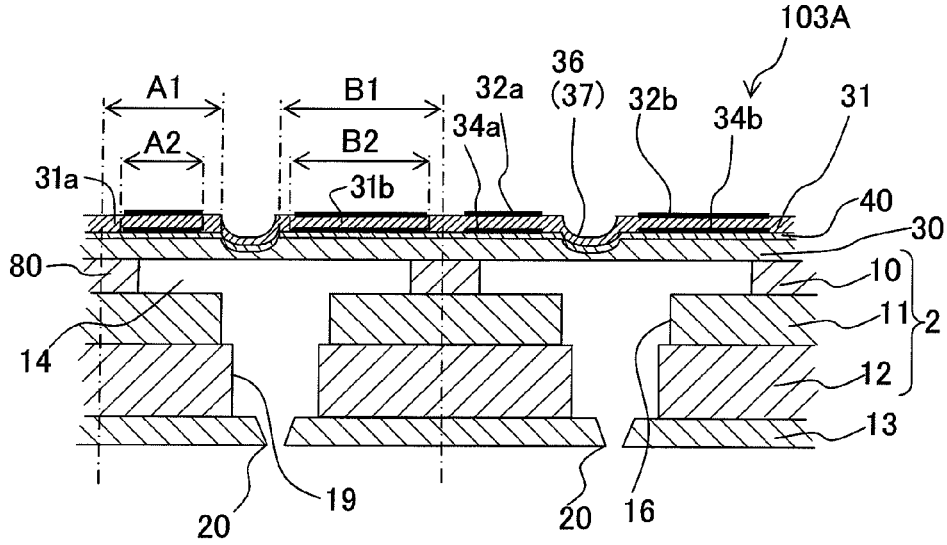
FIG. 22 shows a sectional view illustrating a piezoelectric actuator 103A according to a modified embodiment.

Alternatively, as in a piezoelectric actuator 103A shown in FIG. 22, the widthwise lengths A2, B2 of the individual electrodes 32*a*, 32*b* may be adjusted with respect to the widths A1, B1 of the piezoelectric layers 31*a*, 31*b*, and they may be arranged so that the centers of the respective individual electrodes 32*a*, 32*b* are overlapped with the centers of the piezoelectric layers 31*a*, 31*b*. In this case, the widths A1, B1 of the piezoelectric layers 31*a*, 31*b* mean the lengths of the piezoelectric layers 31*a*, 31*b* ranging from the ends of the recess 36 to the positions overlapped with the centers of the girders 80. The piezoelectric actuator 103A shown in FIG. 22 corresponds the piezoelectric actuator of Sample 3 used in this analysis. In this case, it is possible to suppress the increase amount of the ink discharge velocity caused by the crosstalk and the decrease amount of the ink discharge amount in the same manner as in the piezoelectric actuator 3 described above, as compared with the piezoelectric actuator 5 of Sample 2.

Figure 23:
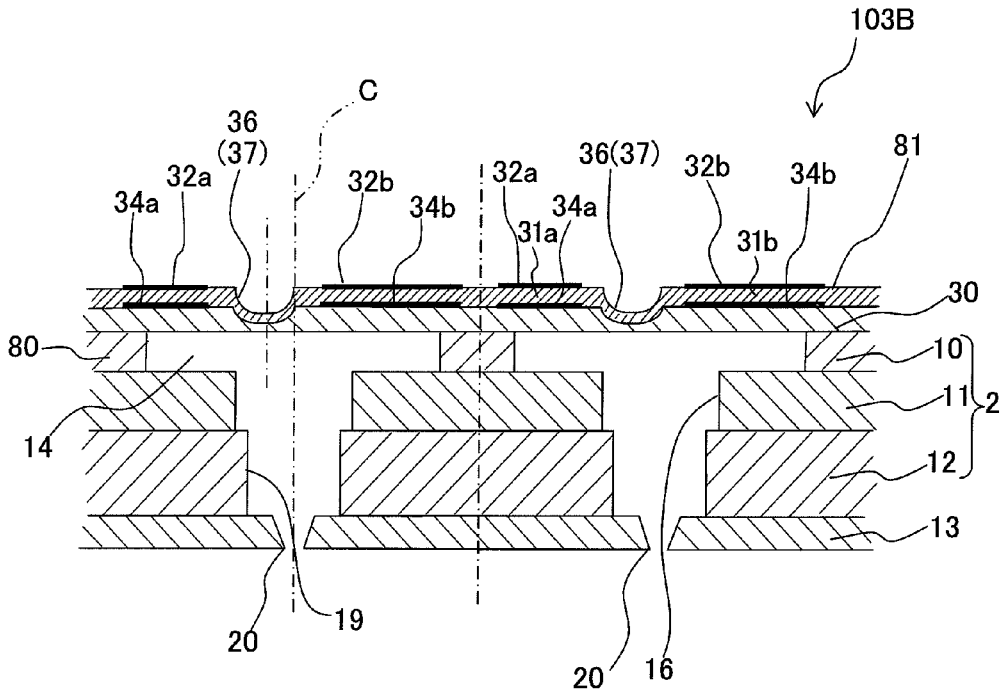
FIG. 23 shows a sectional view illustrating a piezoelectric actuator 103B according to a modified embodiment.

The vibration plate 30 is not limited to those having the conductivity composed of the metal material or the like. For example, it is also allowable to adopt those composed of non-conductive materials such as silicon to which the surface oxidization treatment is applied, synthetic resin, glass materials, and ceramics materials. In the piezoelectric actuator 103B shown in FIG. 23, the vibration plate 30 is formed of the non-conductive material. In this case, it is unnecessary to interpose the insulating film 40 between the vibration plate 30 and the common electrode 34*a*, 34*b*. It is possible to simplify the production steps. That is, the recesses 36 may be formed on the non-conductive vibration plate 30, for example, by means of the etching, the press working, or the injection molding, and the vibration plate 30 may be joined to the surface of the cavity plate 10. After that, the common electrodes 34*a*, 34*b* may be formed in the areas of the surface of the vibration plate 30 overlapped with the respective pressure chambers 14 by using, for example, the screen printing method, the vapor deposition method, or the sputtering method.

The rigidity of the vibration plate 30 can be further decreased, because it is unnecessary to stack the insulating film 40 on the vibration plate 30, as compared with the case in which the insulating film 40 is stacked on the vibration plate 30. Further, it is possible to simplify the production steps.

Figure 24:
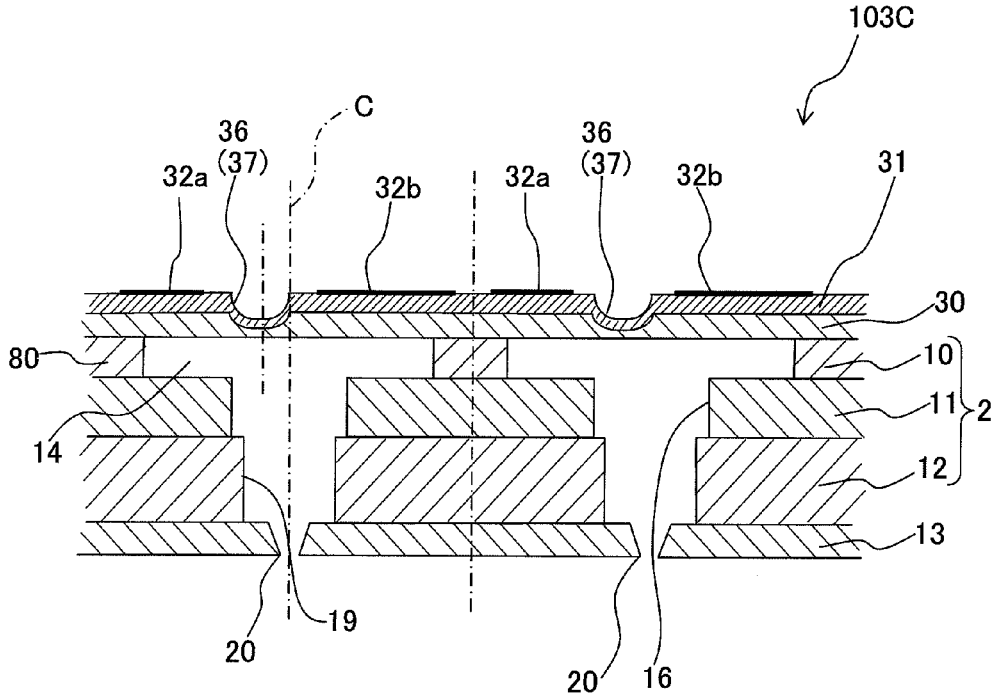
FIG. 24 shows a sectional view illustrating a piezoelectric actuator 103C according to a modified embodiment.

Further, a conductive material such as a metal material may be used for the vibration plate 30 so that the vibration plate 30 also serves as the common electrode. In a piezoelectric actuator 103C shown in FIG. 24, the piezoelectric layer 31 is stacked on the surface of the vibration plate 30 disposed on the side opposite to the pressure chamber 14. The individual electrodes 32*a*, 32*b*, which have different sizes in the transverse direction (width direction orthogonal to the longitudinal direction), are formed at the positions corresponding to the pressure chamber 14 on the upper surface of the piezoelectric layer 31. The lengths of the individual electrodes 32*a*, 32*b* in the transverse direction are adjusted on the basis of the positional deviation amount from the central position in relation to the pressure chamber 14 and the recess 36 detected by the positional deviation-detecting step. The area of the piezoelectric layer 31, which corresponds to the individual electrode 32*a*, 32*b*, is the driving area. As for the vibration plate 30, at least the surface to make contact with the piezoelectric layer 31 may have the conductivity. The common electrodes 34*a*, 34*b* are not formed as well in addition to the insulating film 40 in the piezoelectric actuator 103C. Therefore, it is possible to further simplify the production steps.

Figure 25A:
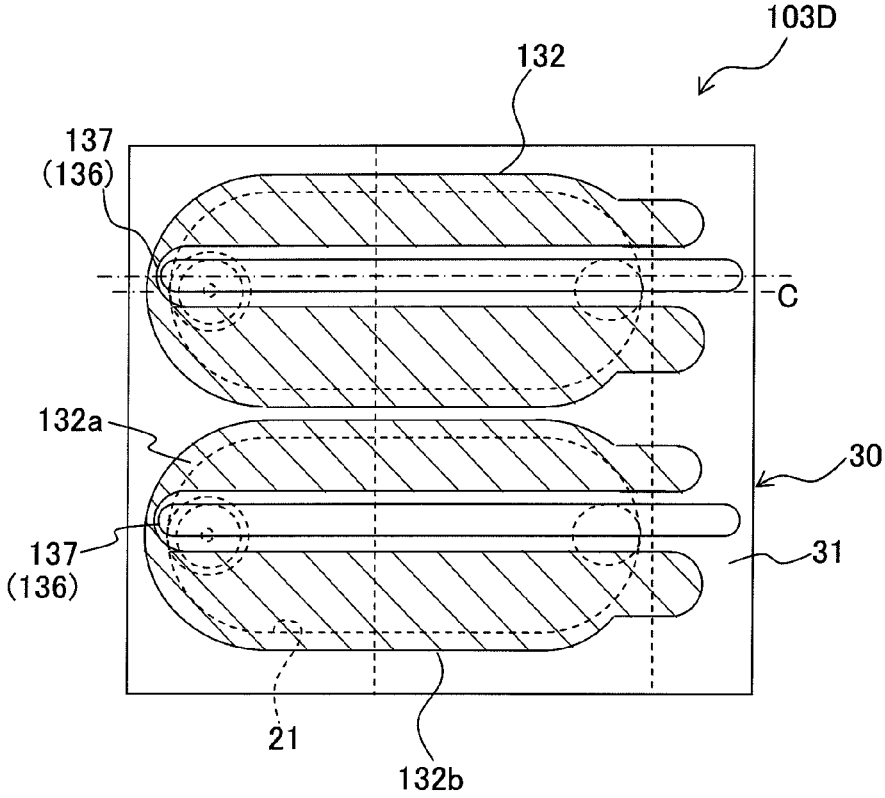
FIGS. 25A and 25B show plan views illustrating piezoelectric actuator 103D, 103E according to modified embodiments, respectively.
Figure 25B:
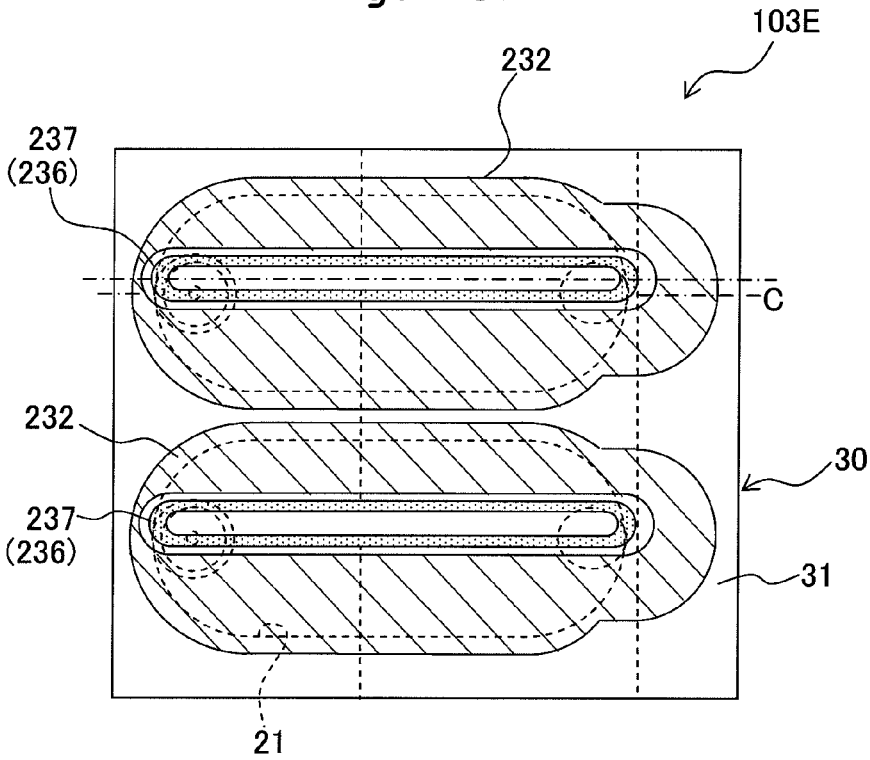

Individual electrodes 132*a*, 132*b* may be connected to one another on one end side in the longitudinal direction of the pressure chamber 21 as in a piezoelectric actuator 103D shown in FIG. 25A. In this case, the individual electrode 132*a*, 132*b* has a substantially U-shaped form as viewed in a plan view. Grooves 136, 137, which are formed in areas overlapped with the substantially central portion of the pressure chamber 21, of the piezoelectric layer 31 and the vibration plate 30 respectively, may extend while exceeding the pressure chamber on the other end side in the longitudinal direction of the pressure chamber 21. Alternatively, as in a piezoelectric actuator 103E shown in FIG. 25B, ring-shaped grooves 236, 237 having elliptic shapes as viewed in a plan view may be formed respectively in areas overlapped with the substantially central portion of the pressure chamber 21, of the piezoelectric layer 31 and the vibration plate 30. Ring-shaped individual electrodes 232 to surround the grooves 236, 237 may be formed. In any case, it is possible to suppress, in the same manner as in the piezoelectric actuator 3 described above, the increase amount of the ink discharge velocity caused by the crosstalk and the decrease amount of the ink discharge amount by adjusting the areal size in which the individual electrode 132*a*, 132*b*, 232 and the girder are overlapped with each other, depending on the positional deviation amount of the vibration plate 30.

The common electrodes 34*a*, 34*b* may be larger than the individual electrodes 32*a*, 32*b* as viewed in a plan view. In this case, the size and the arrangement of the individual electrode are adjusted on the basis of the positional deviation detected in the positional deviation-detecting step, while it is unnecessary to adjust the size and the arrangement of the common electrode. Therefore, it is possible to simplify the production steps.

Alternatively, the individual electrodes 32*a*, 32*b* may be arranged between the piezoelectric layer 31 and the vibration plate 30, and the common electrodes 34*a*, 34*b* may be arranged on the upper surface of the piezoelectric layer 31. In this case, the individual electrodes 32*a*, 32*b* are positioned on the lower surface of the piezoelectric layer 31. Therefore, it is necessary that the wirings of the individual electrodes 32*a*, 32*b* are led to the outside of the piezoelectric layer 31. The individual electrodes 32*a*, 32*b* are connected to one another by lead wires respectively, and the respective lead wires are allowed to extend in the in-plane direction of the vibration plate 30 so that the respective lead wires are not overlapped with the recesses 36, and the lead wires are exposed to the outside of the piezoelectric actuator 3 (not shown).

The embodiment and the modified embodiments thereof described above are examples in which the present invention is applied to the ink-jet head for jetting the ink from the nozzles. However, the liquid transport apparatus, to which the present invention is applicable, is not limited to the ink-jet head. For example, the present invention is applicable to various types of liquid transport apparatuses in order that a fine wiring pattern is formed on a substrate by jetting a conductive paste, a high definition display is formed by jetting an organic light-emitting material to a substrate, and a fine optical device such as an optical waveguide is formed by jetting a resin having the transmitting property to a substrate.

The present invention is also applicable to any liquid droplet-jetting apparatus for jetting any liquid other than the ink including, for example, those for reagents, biological solutions, wiring material solutions, electronic material solutions, refrigerants, and fuel as well as to any liquid transport apparatus having no nozzle for transporting the liquid as described above.

What is claimed is:

1. A method for producing a liquid transport apparatus which transports a liquid and which includes a flow passage unit having a pressure chamber in which an inflow port and a discharge port are formed, and a piezoelectric actuator including: a vibration plate which is joined to the flow passage unit to cover the pressure chamber, the vibration plate having a recess formed on a surface of the vibration plate in an area corresponding to a central portion of the pressure chamber, the surface not facing the pressure chamber; a piezoelectric layer arranged on the vibration plate; and a first electrode which is formed in an area of the piezoelectric layer or the vibration plate, the area not overlapping the central portion of the pressure chamber; and the method comprising:

joining the vibration plate and the flow passage unit to each other in a predetermined positional relationship;

detecting a positional deviation amount, between the vibration plate and the flow passage unit, in a predetermined direction based on the positional relationship after joining the vibration plate and the flow passage unit;

forming the piezoelectric layer by depositing a piezoelectric material on the vibration plate after detecting the positional deviation amount; and forming the first electrode on the piezoelectric layer or the vibration plate in an area overlapping with the pressure chamber such that a length of the first electrode in the predetermined direction is adjusted on the basis of the detected positional deviation amount in the predetermined direction.

2. The method for producing the liquid transport apparatus according to claim 1, wherein a pair of positioning indexes are provided for the flow passage unit and the vibration plate respectively; and the recess is positioned with respect to the pressure chamber by using the pair of positioning indexes when the vibration plate and the flow passage unit are positioned.

3. The method for producing the liquid transport apparatus according to claim 2, wherein when the positional deviation amount is detected, the positioning indexes are used to detect the positional deviation amount of the recess in the predetermined direction.

4. The method for producing the liquid transport apparatus according to claim 1, wherein the first electrode is formed after detecting the positional deviation amount, and then the piezoelectric layer is formed; and after the piezoelectric layer is formed, a second electrode is formed in an area of the piezoelectric layer on a side not facing the first electrode, the area overlapping with the first electrode.

5. The method for producing the liquid transport apparatus according to claim 1, wherein the piezoelectric layer is formed after detecting the positional deviation amount, and then the first electrode is formed; and after the positional deviation amount is detected and before the piezoelectric layer is formed, a second electrode is formed in an area of the piezoelectric layer on a side not facing the first electrode, the area overlapping with the first electrode.

6. The method for producing the liquid transport apparatus according to claim 1, wherein upon forming the first electrode, the first electrode is formed to extend to an area of the piezoelectric layer overlapping with outer area of the flow passage unit located at the outside of the pressure chamber.

7. The method for producing the liquid transport apparatus according to claim 1, wherein the piezoelectric layer is formed by using an aerosol deposition method or a chemical vapor deposition method.

8. The method for producing the liquid transport apparatus according to claim 1, wherein the first electrode is formed such that portions of the first electrode, which is overlapped with the partition wall portion has an identical area irrelevant to the positional deviation amount when the first electrode is formed.

* * * * *